US006772918B2

(12) United States Patent
Mack, Jr.

(10) Patent No.: US 6,772,918 B2
(45) Date of Patent: Aug. 10, 2004

(54) SAFETY CAN

(75) Inventor: Donald F. Mack, Jr., Lovington, IL (US)

(73) Assignee: Justrite Manufacturing Company, Des Plaines, IL (US)

( * ) Notice: Subject to any disclaimer, the term of this patent is extended or adjusted under 35 U.S.C. 154(b) by 48 days.

(21) Appl. No.: 10/265,971

(22) Filed: Oct. 7, 2002

(65) Prior Publication Data

US 2004/0065687 A1 Apr. 8, 2004

(51) Int. Cl.[7] ..... B67D 3/00

(52) U.S. Cl. ..... 222/472; 222/529; 222/556; 222/559; 141/302

(58) Field of Search ..... 222/469–475, 222/527, 529, 556, 559, 566; 141/98, 302

(56) References Cited

U.S. PATENT DOCUMENTS

| | | | | |
|---|---|---|---|---|
| 2,172,142 | A | * | 9/1939 | Lebus ..... 222/474 |
| 3,727,807 | A | * | 4/1973 | Flider ..... 222/469 |
| 3,794,235 | A | * | 2/1974 | Flider ..... 222/471 |
| 3,811,605 | A | * | 5/1974 | Flider ..... 222/472 |
| 4,063,667 | A | | 12/1977 | Flider |
| 4,065,024 | A | | 12/1977 | Atwell |
| 4,138,037 | A | | 2/1979 | Zehr |
| 4,249,563 | A | | 2/1981 | Shaw |
| 4,280,679 | A | | 7/1981 | Shaw |
| 4,458,711 | A | | 7/1984 | Flider |
| 4,460,010 | A | | 7/1984 | Paravigna et al. |
| 4,489,860 | A | | 12/1984 | Flider |
| 4,491,251 | A | | 1/1985 | Pratz et al. |
| 4,492,319 | A | | 1/1985 | Cooper |
| 4,529,099 | A | | 7/1985 | Zerrer |
| 4,552,288 | A | | 11/1985 | Flider |
| 4,597,504 | A | | 7/1986 | Witt |
| 4,645,099 | A | | 2/1987 | Gillispie et al. |
| 4,662,544 | A | | 5/1987 | Gillispie |
| 4,682,627 | A | | 7/1987 | Cooper et al. |
| 4,690,308 | A | | 9/1987 | Cavanaugh et al. |
| 4,819,794 | A | | 4/1989 | Silverstein et al. |
| 4,856,664 | A | | 8/1989 | Gillispie et al. |
| 4,881,647 | A | | 11/1989 | Schiemann et al. |
| 4,941,403 | A | | 7/1990 | Cimenti |
| 4,950,082 | A | | 8/1990 | Carlson |
| 4,969,571 | A | | 11/1990 | Bartz |
| 4,978,004 | A | | 12/1990 | Silverstein et al. |
| 5,056,691 | A | | 10/1991 | Tolbert |
| 5,226,574 | A | | 7/1993 | Durinzi, Jr. |
| 5,249,693 | A | | 10/1993 | Gillispie et al. |
| 5,295,610 | A | | 3/1994 | Levison |
| D350,806 | S | | 9/1994 | Cooper |
| D358,330 | S | | 5/1995 | Kahl |
| 5,462,169 | A | | 10/1995 | Dygert et al. |
| 5,485,942 | A | | 1/1996 | Foster |
| 5,551,454 | A | | 9/1996 | Goncalves |
| 5,553,750 | A | | 9/1996 | Foster |
| 5,564,608 | A | | 10/1996 | Cooper |
| D376,540 | S | | 12/1996 | Boumil |
| 5,597,097 | A | | 1/1997 | Morris |
| 5,601,211 | A | | 2/1997 | Foster |

(List continued on next page.)

*Primary Examiner*—Joseph A. Kaufman
(74) *Attorney, Agent, or Firm*—Leydig, Voit & Mayer, Ltd.

(57) ABSTRACT

A safety can for storing flammable liquid is disclosed. The safety can includes a receptacle and a valve mechanism. The valve mechanism can include a body assembly, a fill cover assembly, a pour valve assembly, a trigger assembly, and a handle. The body assembly of the valve mechanism can be mounted to the receptacle. The body assembly can include a fill spout and a separate pour spout. The fill cover assembly can be pivotally mounted to the body assembly about a fill cover axis. The pour valve assembly can be movably mounted to the body assembly and be disposed therein. The safety can includes a trigger assembly for convenient multi-functional operation of the safety can. The trigger can be positioned to allow the can to be filled, to pour from the can, and to place the container in a safety position.

32 Claims, 31 Drawing Sheets

U.S. PATENT DOCUMENTS

| | | | |
|---|---|---|---|
| D380,682 | S | 7/1997 | Robinson |
| 5,660,204 | A | 8/1997 | Piotrowski et al. |
| 5,660,292 | A | 8/1997 | Scholfield |
| 5,662,249 | A | 9/1997 | Grosse |
| 5,671,868 | A | 9/1997 | Herr |
| 5,683,007 | A | 11/1997 | Scholfield |
| 5,746,359 | A | 5/1998 | Stanek et al. |
| 5,833,094 | A | 11/1998 | Willis |
| 5,897,021 | A | 4/1999 | Babcock |
| 5,961,006 | A | 10/1999 | Dunham et al. |
| 5,966,743 | A | 10/1999 | Flann |
| 5,967,370 | A | 10/1999 | Nettles et al. |
| 6,003,735 | A | 12/1999 | Strecker |
| 6,006,959 | A | 12/1999 | Naden et al. |
| 6,056,005 | A | 5/2000 | Piotrowski et al. |
| 6,176,474 | B1 | 1/2001 | Stanek et al. |
| 6,196,255 | B1 | 3/2001 | Poillucci |
| 6,244,457 | B1 | 6/2001 | Piotrowski et al. |
| 6,390,153 | B1 | 5/2002 | Flider et al. |

* cited by examiner

SAFETY CAN

FIELD OF THE INVENTION

The present invention relates in general to a safety container for storing flammable fluids, and in particular to a safety container that includes a valve assembly with a pour spout, a fill spout, and a venting system.

BACKGROUND OF THE INVENTION

The invention relates to safety cans or containers for holding fluids and especially, although not exclusively, to containers for flammable fluids such as gasoline and the like. In general, these safety containers may be one of two types. The first type is commonly referred to as a Type I can. The Type I can is a container with one spout through which both filling and pouring are accomplished.

The Type I can is typically used in applications where liquid is to be poured from the can into a container having a wider opening than the opening of the Type I can. In instances where the receiving container has an opening that is smaller than the opening of the safety can a hinged funnel attachment can be installed on the safety can to prevent spillage during the filling operation. The Type I can may be inconvenient to use in the latter situation because it can be burdensome to place the funnel attachment in line with the spout when pouring from the can, move the funnel away from the spout when filling the can, and then return the funnel over the spout for pouring again.

The second type is commonly referred to as a Type II can. The Type II can is a container with two separate spout openings, one used to fill the can and the other used to pour therefrom. Typically, there is a hose associated with the pouring spout to allow pouring into a small opening. Also, a Type II can includes a venting feature.

A Type II can is more convenient to pour from than a Type I can because the Type II can may include an attached hose that does not need to be detached when the can is being filled. However, the Type II can of the prior art is often more expensive to produce than the Type I can because of the necessity of providing two spouts, for example. Furthermore, the mechanisms for operating the dual spouts can be complicated and difficult to use.

The present invention is generally directed toward providing a safety container.

SUMMARY OF THE INVENTION

The present invention provides a safety can for storing flammable liquids, such as, gasoline, diesel fuel, and the like, for example. The safety can may include a valve mechanism that provides a Type II configuration with a pair of spouts, a fill spout and a pour spout. The safety can includes a trigger assembly for convenient multi-functional operation of the safety can. The trigger can be positioned to allow the can to be filled, to pour from the can, and to place the container in a safety position. The safety can of the present invention allows for the convenient operation of the safety can while providing a readily useable means for operating the safety container.

In one aspect of the invention, the safety can includes a receptacle and a valve mechanism. The valve mechanism can include a body assembly, a fill cover assembly, a pour valve assembly, a trigger assembly, and a handle. The body assembly of the valve mechanism can be mounted to the receptacle. The body assembly can include a fill spout and a separate pour spout. The fill cover assembly can be pivotally mounted to the body assembly about a fill cover axis. The pour valve assembly can be movably mounted to the body assembly and be disposed therein.

The trigger assembly can be pivotally mounted to the body assembly about a trigger axis. The trigger assembly can include a trigger and a connecting link. The connecting link of the trigger assembly can be pivotally mounted to the fill cover assembly about a connecting link axis for selective movement of the fill cover assembly between a closed position and an open position. The fill cover can be moved to the open position by moving the connecting link away from the receptacle and moving the trigger toward the receptacle.

The trigger assembly can be moved to a safety position in the event that the trigger is moved without first moving the connecting link away from the receptacle.

The trigger assembly can be operably engaged with the pour valve assembly for selective movement of the pour valve assembly between a closed position and an open position. Moving the trigger away from the receptacle can move the pour valve assembly from the closed position to the open position.

The safety can of the present invention can include an integral automatic venting system to facilitate pouring liquid from the can. The venting system can be linked to the pour valve actuation system. The venting system can resist venting as a result of increased pressure build up within the can. Pressure build up can be vented through the fill cover assembly in the event such pressure rises above a predetermined value.

The handle can be mounted to the body assembly. A flexible hose can be mounted to the body assembly to facilitate the dispensing of liquid from the safety can.

In another aspect of the invention, the safety container can include a cage to protect the valve assembly. A clamp can be mounted to the fill cover assembly to provide an additional safety feature. The clamp can include a thumbscrew for selectively engaging the fill cover to secure the clamp thereto. The clamp can be pivoted out of the way when not in use. The clamp can include a fusible link configured to sever upon reaching a predetermined temperature.

The features of the present invention will become apparent to one of ordinary skill in the art upon reading the detailed description, in conjunction with the accompanying drawings, provided herein.

DETAILED DESCRIPTION OF EMBODIMENTS OF THE INVENTION

In accordance with the teachings of the present invention, there is provided a safety can for storing flammable liquid such as gasoline, diesel fuel, and the like. The safety can of the present invention can include a receptacle and a valve mechanism having a fill spout and a separate pour spout. The valve mechanism can include an ergonomic, triple-function trigger mechanism. The trigger can be operated to actuate a pour valve assembly to pour liquid from the can when the trigger is moved away from the receptacle. The trigger can also be used to open a fill cover assembly for filling the can. A connecting link can be lifted away from the receptacle to engage the trigger. The trigger can be moved toward the receptacle to open a fill cover of the fill cover assembly. After a desired amount of fluid is conveyed to the receptacle, the trigger can be released to automatically close the fill cover. In a third function, the trigger can include a safety feature to prevent unintentional opening of the fill cover which allows for the trigger to be placed in a range of safety positions when the connecting link is not engaged with the trigger without affecting the position of the fill cover.

The safety can of the present invention can include an integral automatic venting system to facilitate pouring liquid from the can. The venting system can be linked to the pour valve actuation system.

The present invention is similar in some respects to the safety container disclosed in U.S. Pat. No. 6,390,153 issued on May 21, 2002, to Flider et al., said patent being incorporated herein in its entirety by this reference.

Figure 1:
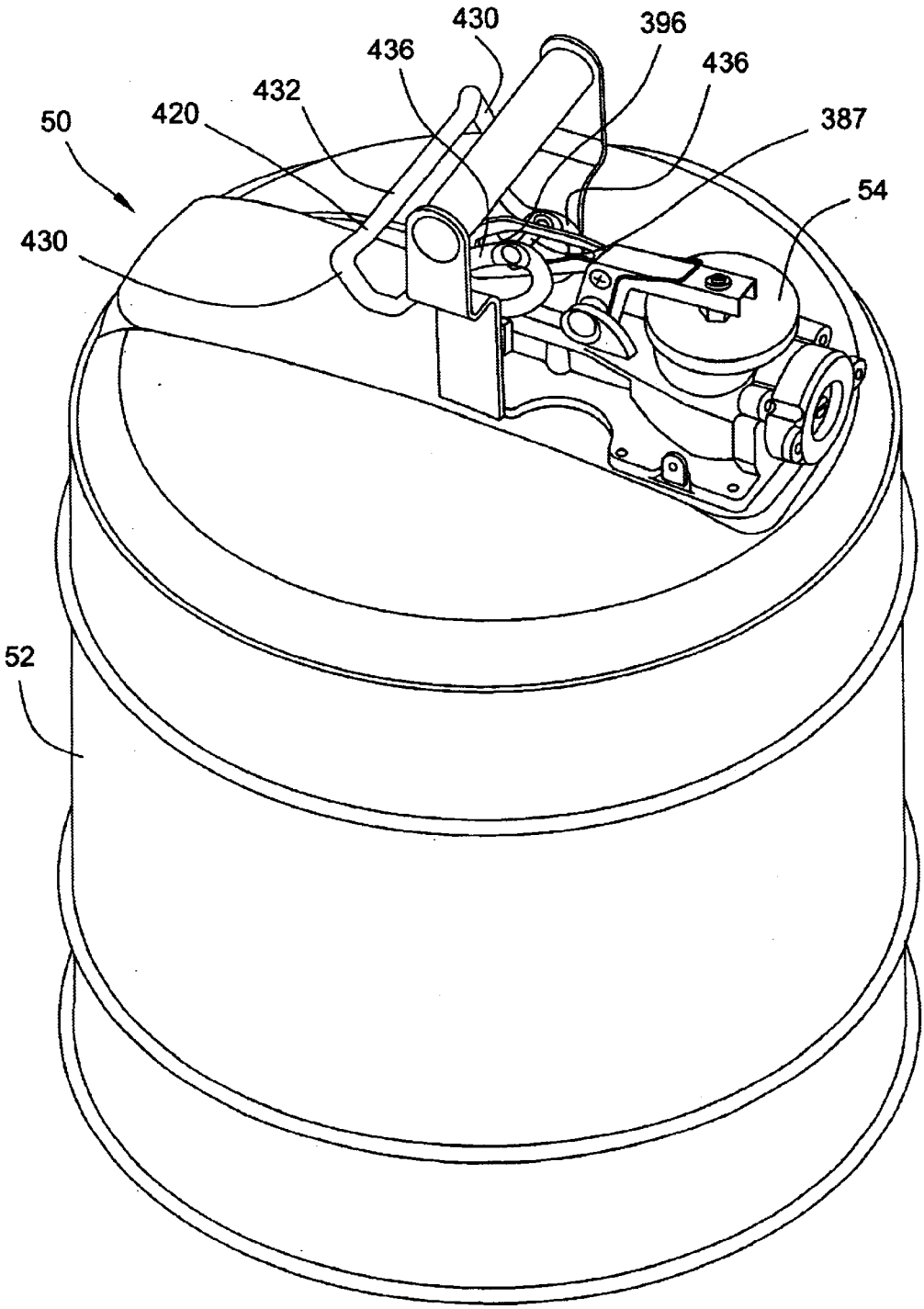
FIG. 1 is a perspective view of a safety can according to the present invention, the safety can including a receptacle and a valve mechanism.

Now referring to the drawings, there is shown in FIG. 1 an illustrative safety can 50 including a receptacle 52 and a valve mechanism 54 according to the present invention. The valve mechanism 54 is mounted to the receptacle 52.

Figure 2:
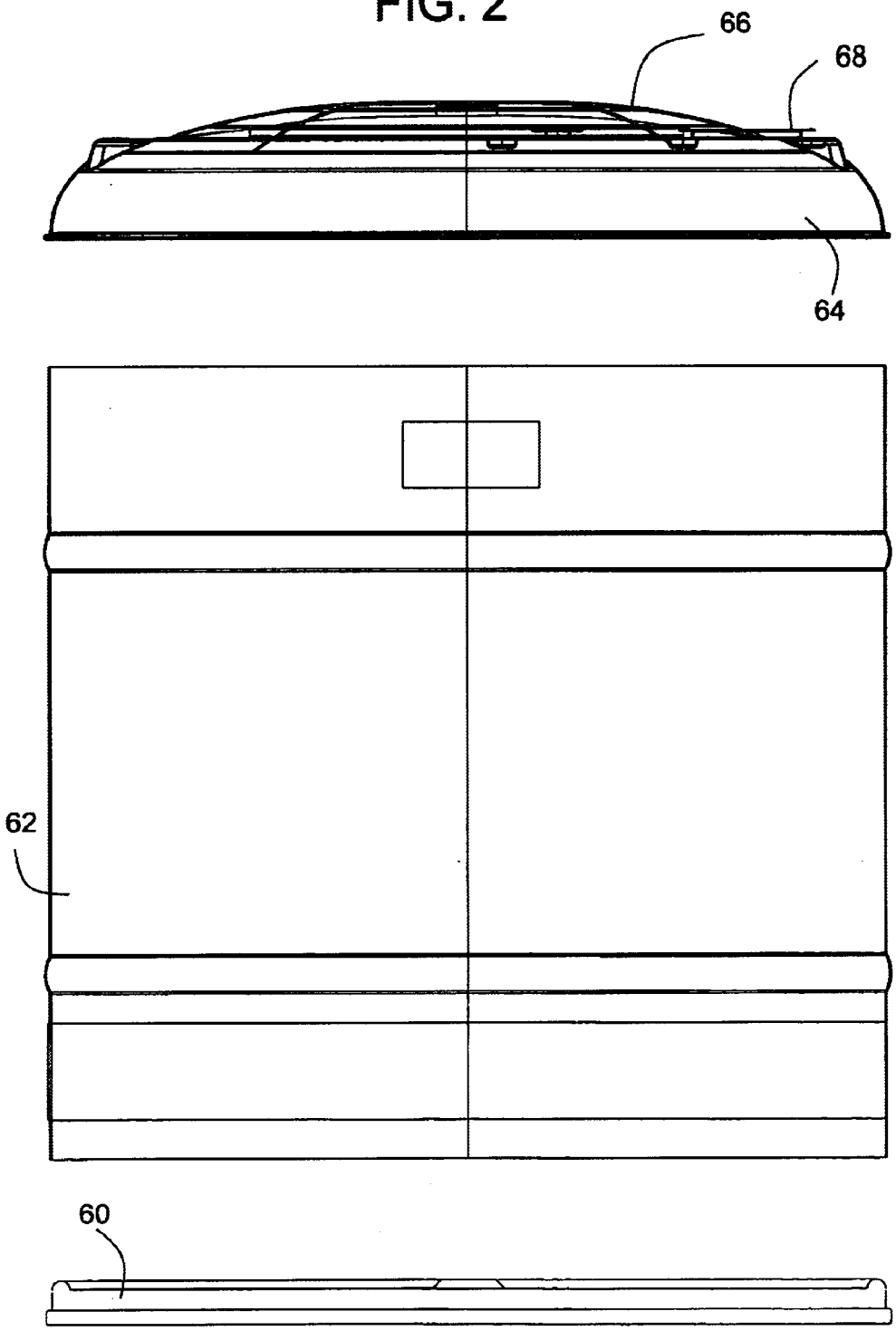
FIG. 2 is an exploded view of the receptacle of the safety can of FIG. 1.

Referring to FIG. 2, the receptacle 52 can be provided to store a predetermined amount of liquid, such as a flammable liquid, for example. The receptacle 52 can be configured to have a three-gallon or a five-gallon capacity, for example. The receptacle 52 can include a base 60, a side wall portion 62, and a dome 64. The base 60 is generally planar and has a generally circular shape. The side wall portion 62 is generally cylindrical. The dome 64 presents a convex outer surface 66 that includes a flat portion 68 for receiving the valve mechanism 54. The base 60, the side wall portion 62, and the dome 64 can be mounted together to define an inner chamber for holding fluid. The components of the receptacle can be made from any suitable material, such as metal, for example. The components of the receptacle can be joined together in a liquid-tight fashion.

Figure 3:
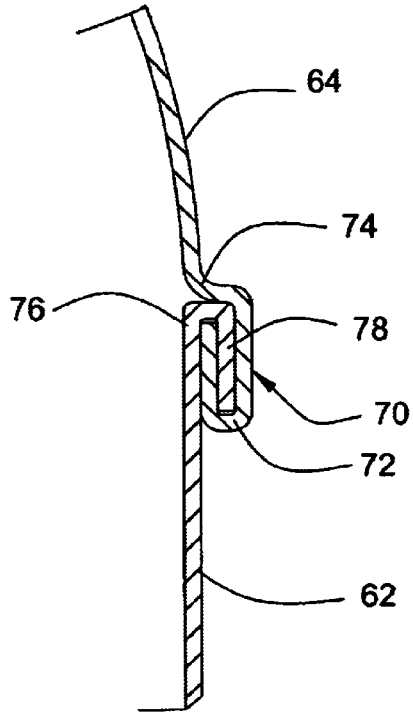
FIG. 3 is an enlarged, detail view, in section, of a dome and a side wall portion of the receptacle of FIG. 1.

Referring to FIG. 3, the dome 64 and the side wall portion 62 of the receptacle can be connected to each other by a liquid-tight first seam 70. The dome 64 includes a generally U-shaped first lip 72 that extends around the circumference of the dome. The first lip 72 depends from a bottom edge 74 of the dome, extending toward the side wall portion 62. A top end 76 of the side wall portion 62 includes a first flange 78 that extends around the perimeter of the side wall portion 62. The first lip 72 and the first flange 78 cooperate together to provide the first seam 70.

Figure 4:
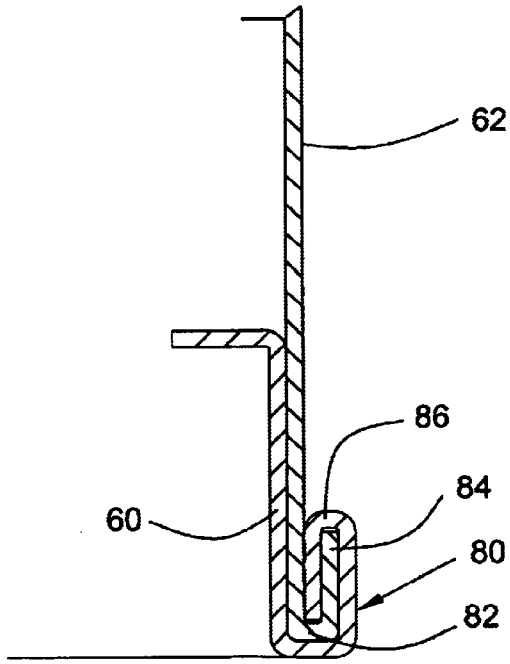
FIG. 4 is an enlarged, detail view, in section, of the side wall portion and a base of the receptacle of FIG. 1.

Referring to FIG. 4, the side wall portion 62 and the base 60 of the receptacle can be connected to each other by a liquid-tight second seam 80. A bottom end 82 of the side wall portion 62 includes a second flange 84 that extends around the perimeter of the side wall portion. The base 60 includes a generally U-shaped second lip 86 that extends around the circumference of the base. The second lip 86 extends from the base 60 toward the second flange 84 of the side wall portion 62. The second lip 86 and the second flange 84 cooperate together to provide the second seam 80.

Figures 5, 7:
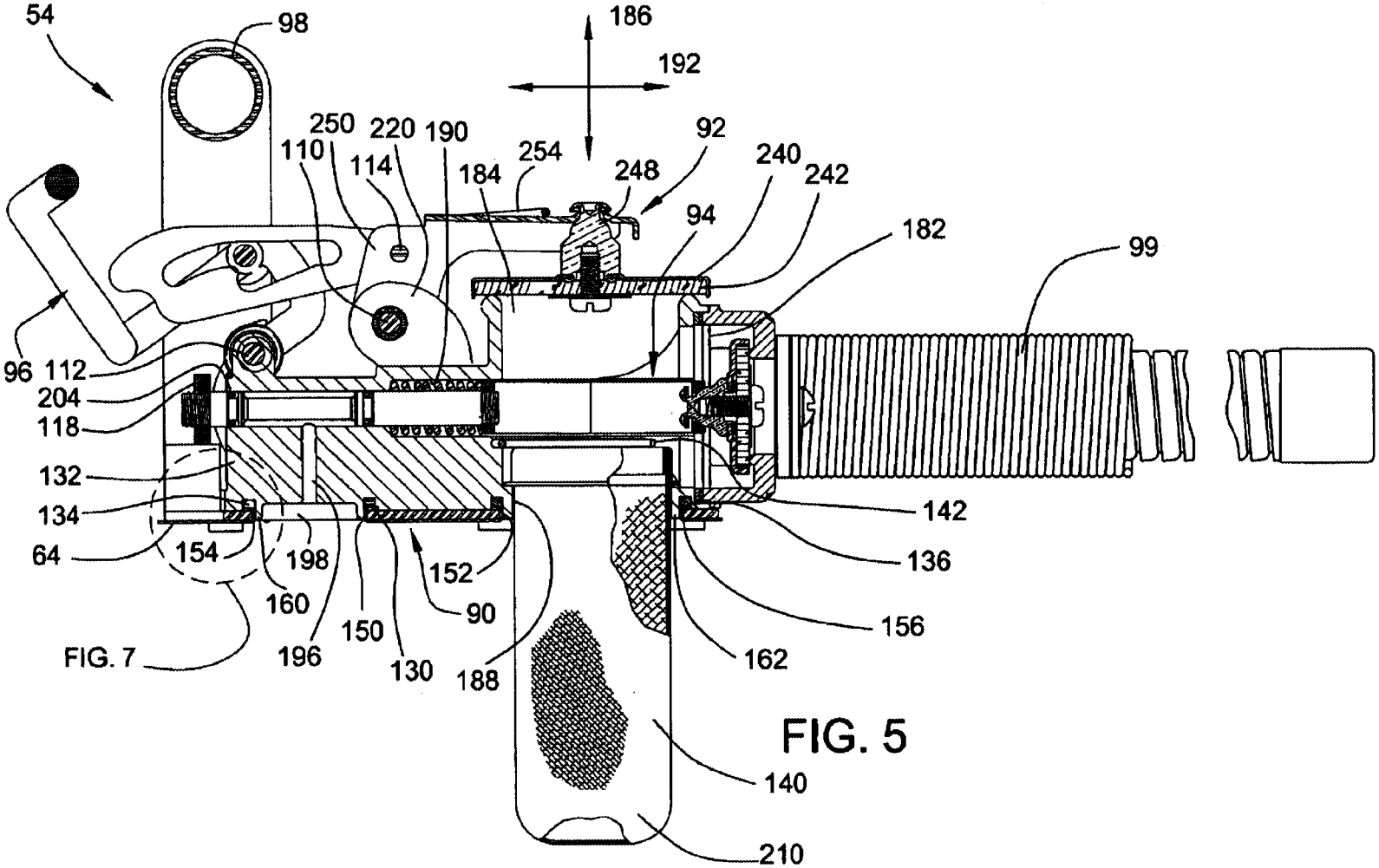
FIG. 5 is a cross-sectional view of the valve mechanism of the safety can of FIG. 1.
FIG. 7 is an enlarged, detail view taken from FIG. 5.

Referring to FIG. 5, to provide a Type II configuration to the safety container the valve mechanism 54 can be provided. The valve mechanism 54 can include a body assembly 90, a fill cover assembly 92, a pour valve assembly 94, a trigger assembly 96, and a handle 98. A flexible hose 99 can be mounted to the body assembly 90 to facilitate the dispensing of liquid from the safety can.

The body assembly 90 of the valve mechanism can be mounted to the dome 64 of the receptacle. The fill cover assembly 92 can be pivotally mounted to the body assembly 90 about a fill cover axis 110. The pour valve assembly 94 can be movably mounted to the body assembly 90. The pour valve assembly 94 can be disposed within the body assembly 90.

Figure 23:
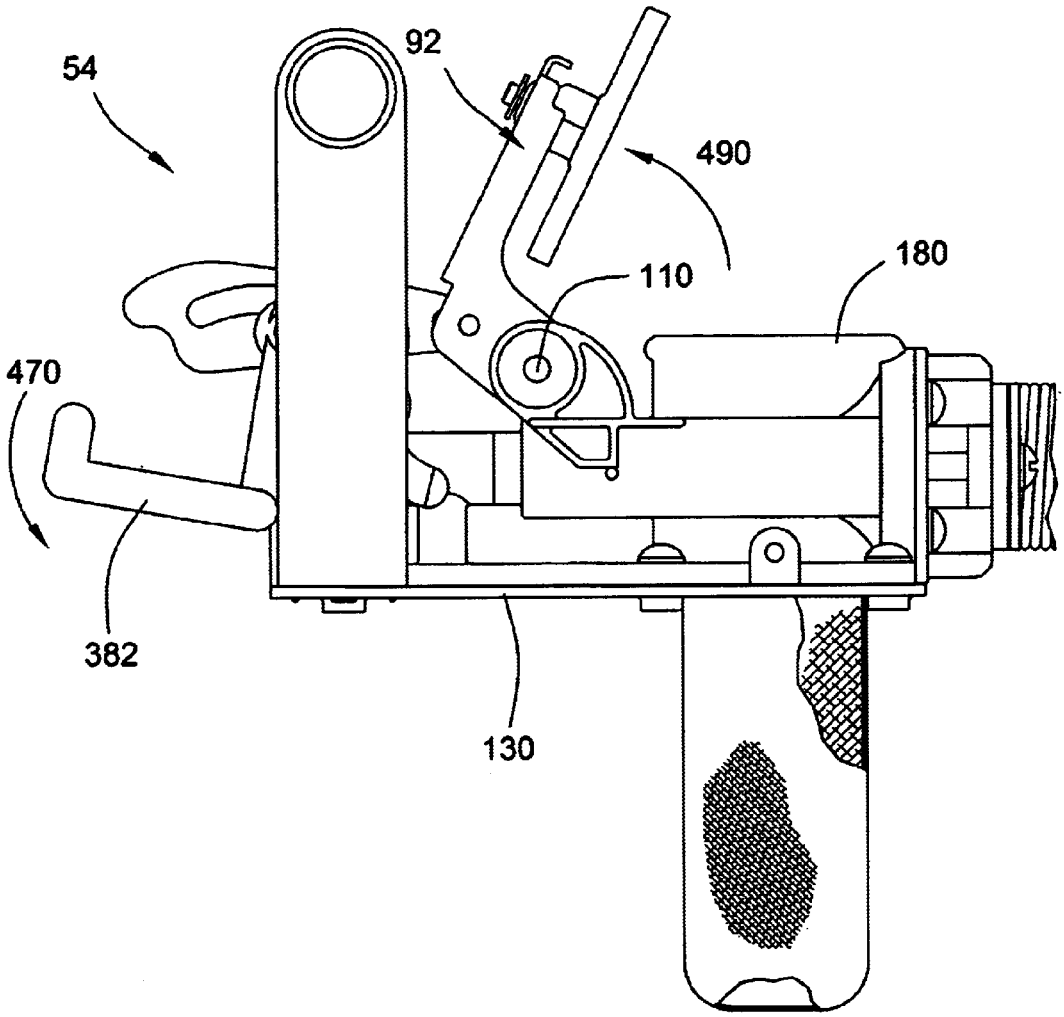
FIG. 23 is a side elevational view of the valve mechanism similar to FIG. 17, but illustrating the valve mechanism in a fill position.
Figure 28:
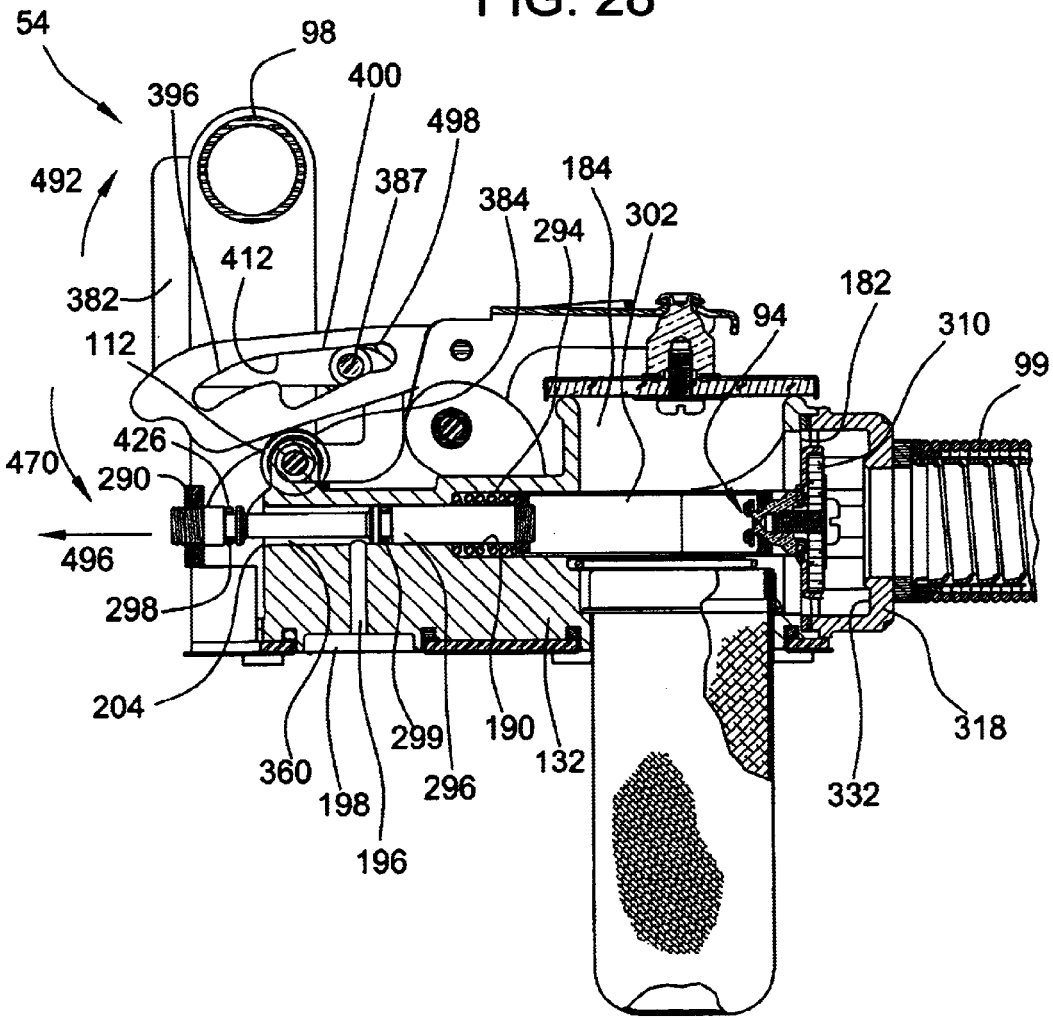
FIG. 28 is a side elevational view of the valve mechanism similar to FIG. 27, partially broken away for illustrative purposes.

The trigger assembly 96 can be pivotally mounted to the body assembly 90 about a trigger axis 112. The trigger assembly 96 can be pivotally mounted to the fill cover assembly 92 about a connecting link axis 114 for selective movement of the fill cover assembly 92 between a closed position, as shown in FIG. 5, and an open position, as shown in FIG. 23. The trigger assembly 96 can be operably engaged with a portion 118 of the pour valve assembly 94 which extends from the body assembly 90 for selective movement of the pour valve assembly 94 between a closed position, as shown in FIG. 5, and an open position, as shown in FIG. 28.

The handle 98 can be mounted to the body assembly 90.

Figure 6:
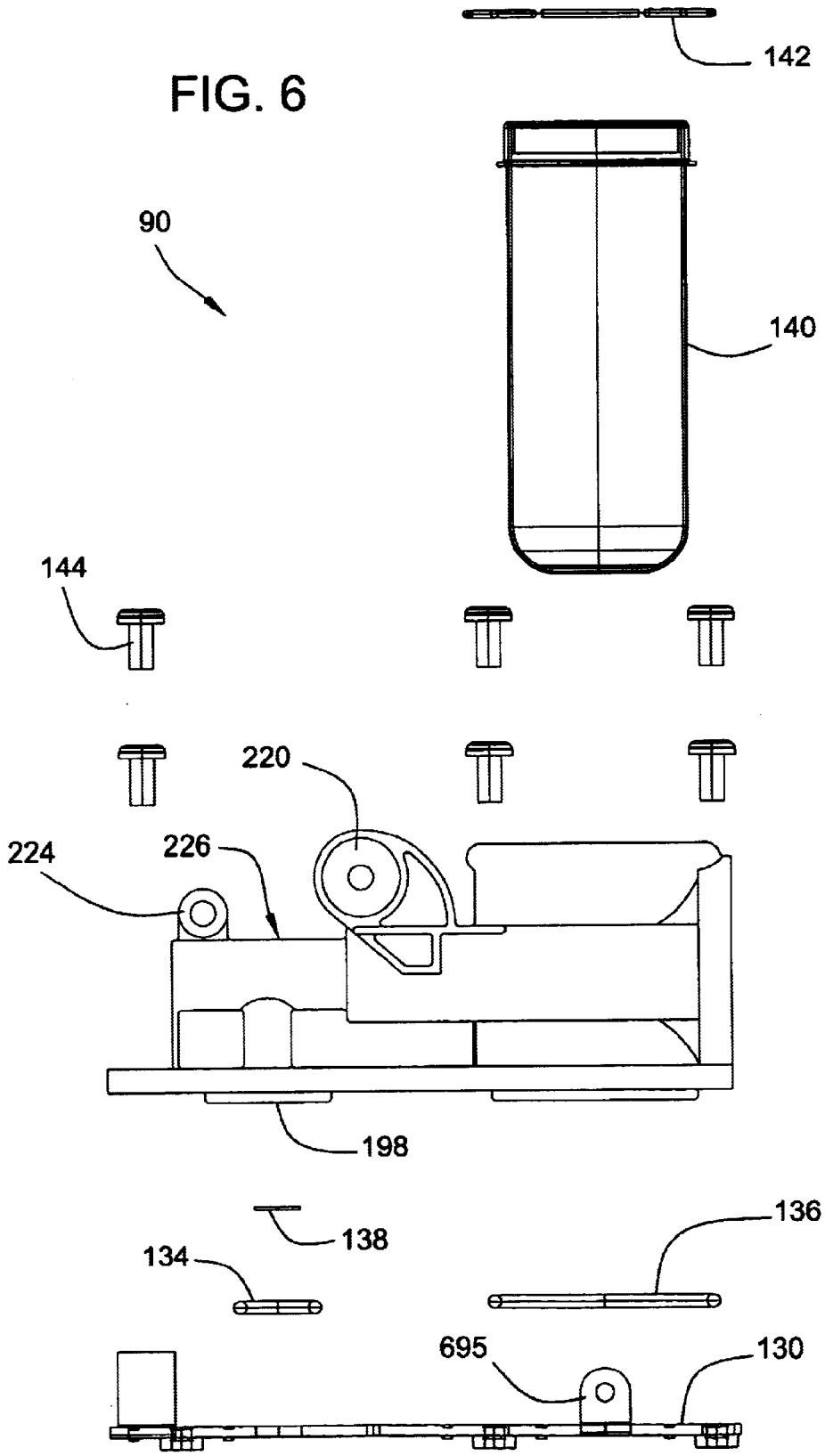
FIG. 6 is an exploded view of a body assembly of the valve mechanism of FIG. 1.
Figure 7:
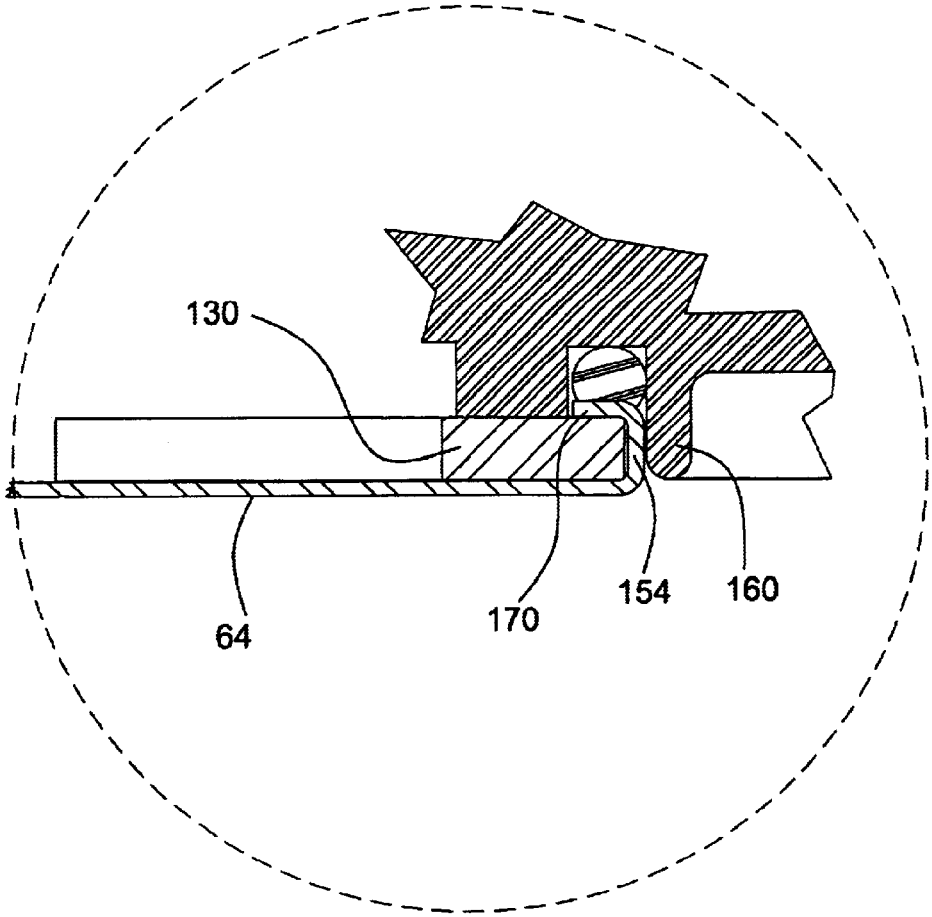

Referring to FIG. 6, the body assembly 90 of the valve mechanism can be provided to define a fill spout, a pour spout, and a venting passage. The body assembly 90 can include a mounting plate 130, a body 132, a vent O-ring 134, a main O-ring 136, a vent flame arrestor 138, a main flame arrestor 140, a lock wire 142, and a plurality of mounting screws 144.

The mounting plate 130 can be mounted to the dome of the receptacle. The mounting plate 130 includes a vent opening 150 and a main opening 152, as shown in FIG. 5. Referring to FIG. 5, the dome 64 also includes a corresponding vent opening 154 and main opening 156 therein. The body 132 includes a vent boss 160 and a main boss 162, which respectively extend into the vent openings 150, 154 and the main openings 152, 156 of the mounting plate and the dome. The vent O-ring 134 can be disposed about the vent boss 160 to provide a seal between the body 132 and the mounting plate 130. The main O-ring 136 can be disposed about the main boss 162 to provide a seal between the body 132 and the mounting plate 130.

Referring to FIG. 7, the dome 64 can include a flanged portion 170 about each opening therein. The flanged portions 170 of the openings can extend into the respective mating openings of the mounting plate 130 to thereby retentively engage the mounting plate 130 to the dome 64. The dome 64 can be rolled over the mounting plate 130 in at least two places to retain the mounting plate 130 thereto. The mounting of the plate 130 in this fashion can serve to eliminate the need for a second seal between the plate and the receptacle.

In one method, each flanged portion 170 can be made by extruding a portion of the material of the dome. The extruded portion can be acted upon in a multi-stage die wherein in a first stage the extruded portion is flared to about a 45° angle and in a second stage the material is deformed to yield the flanged portion.

Referring to FIG. 5, the body includes a fill spout 180, a pour spout 182, a main passage 184 that extends along a main axis 186, a main opening 188, a pour valve passage 190 extending along a valve axis 192, which is perpendicular to the main axis 186, a vent passage 196, and a vent opening 198. The main passage 184 communicates with the fill spout 180, the pour spout 182, and the main opening 188. The pour valve passage 190 communicates with the main passage 184 and includes a rear opening 204 to the outside. The vent passage 196 communicates with the pour valve passage 194. The vent opening 198 and the main opening 188 are disposed within the vent boss 160 and the main boss 162, respectively. The vent opening 198 and the main opening 188 communicate with the inner chamber of the receptacle.

The main flame arrestor 140 and the lock wire 142 can be disposed in the main passage 184 of the body 132 with a portion 210 of the main flame arrestor 140 extending from the body 132 through the main opening 188 into the receptacle to provide a vent arresting feature for the main passage. Referring to FIG. 6, the vent flame arrestor 138 can be disposed with respect to the vent opening 198 of the body 132 to provide a flame arrestor feature for the vent passage.

Figure 8:
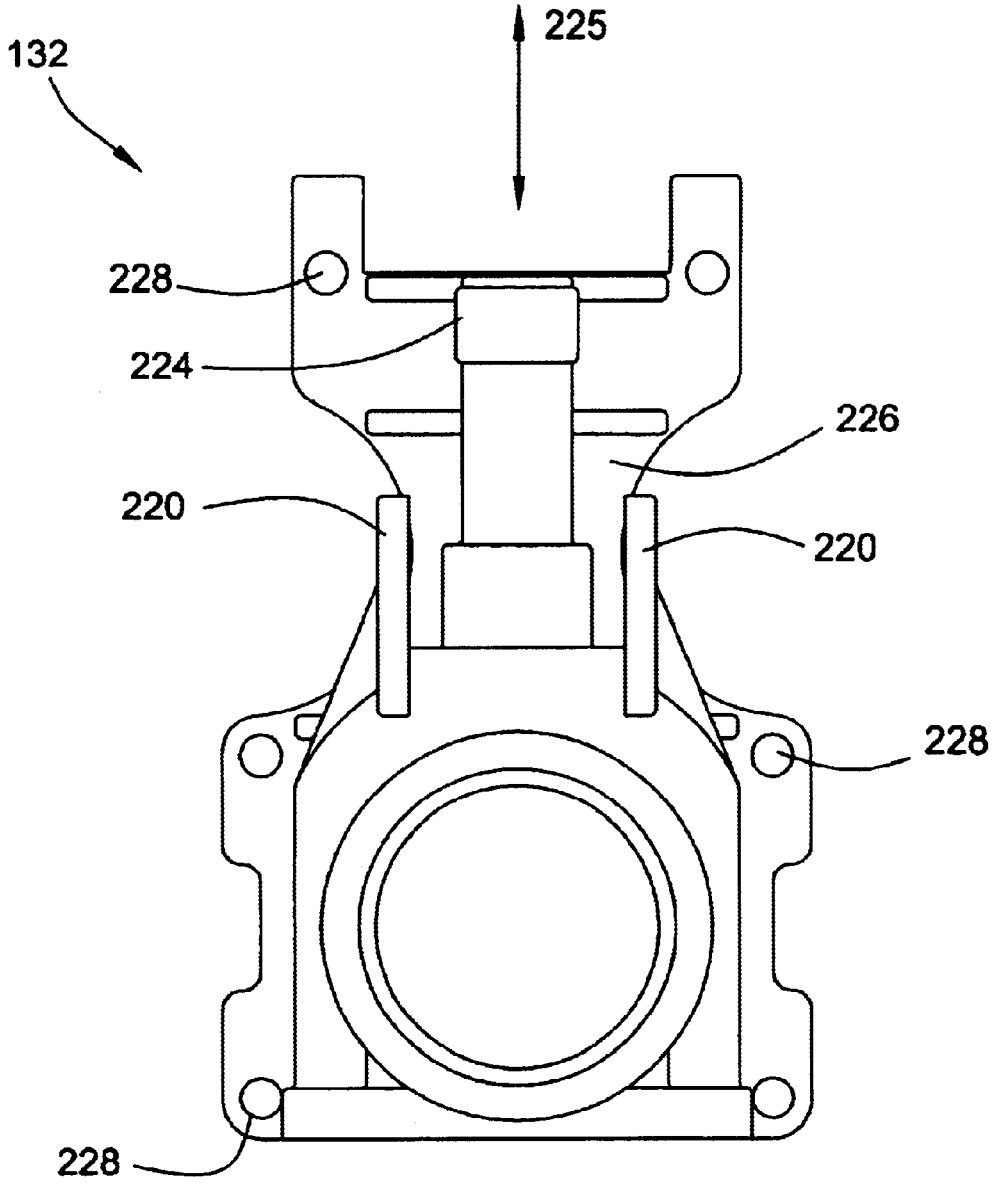
FIG. 8 is a top plan view of a body portion of the body assembly of FIG. 6.

Referring to FIGS. 6 and 8, the body 132 can include a pair of fill cover supports 220 in spaced relationship to each other and a trigger support 224 disposed substantially along a central longitudinal axis 225 thereof. The supports 220, 224 project from an outer surface 226 of the body 132. The body 132 includes a plurality of mounting holes 228 for receiving the mounting screws 144.

The valve plate 130 can be made from steel, for example. The valve body 132 can be made from die cast zinc, for example.

The flame arrester 140 can include two different sized grid screens which can be held together by a steel collar.

Figure 9:
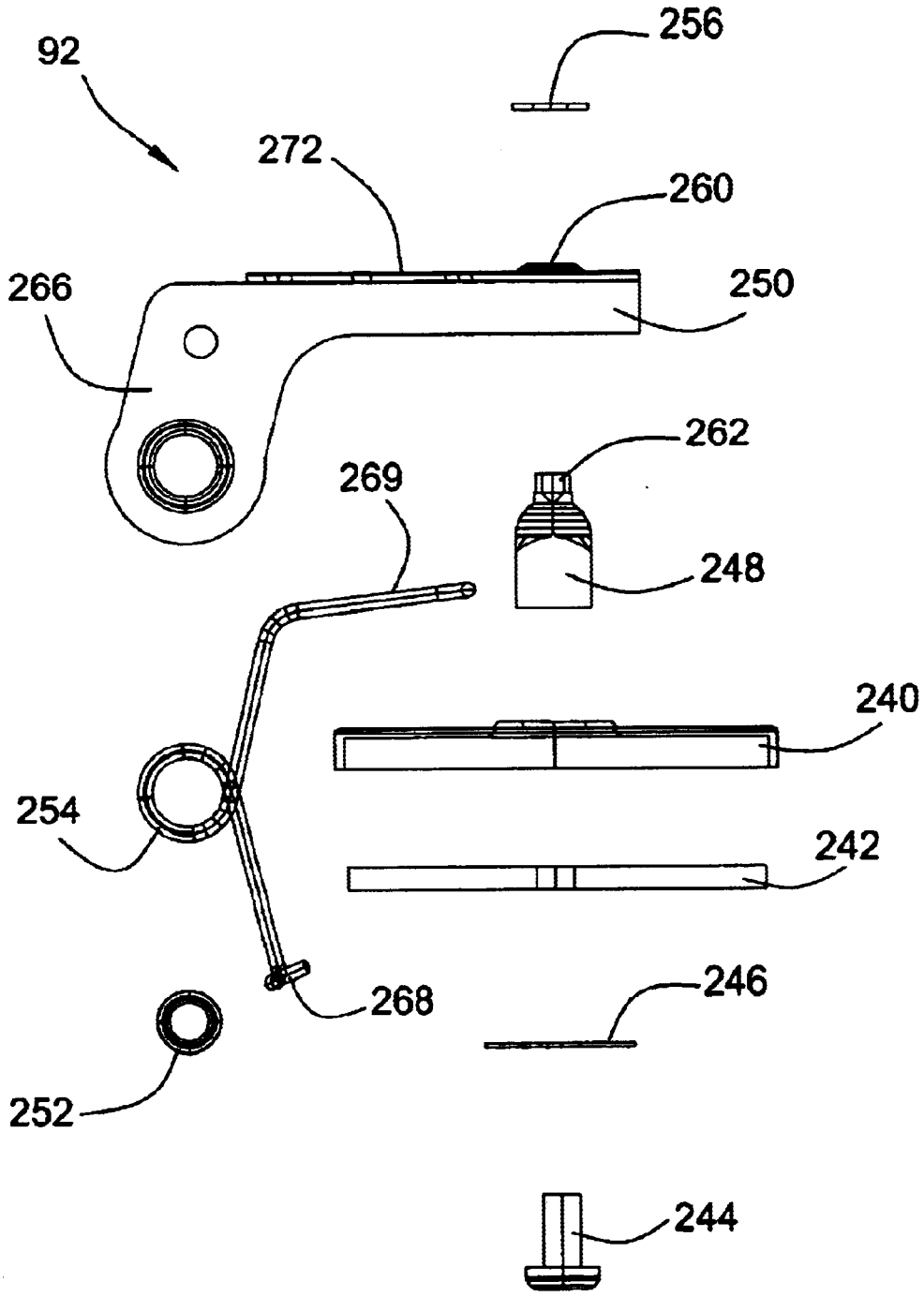
FIG. 9 is an exploded view of a fill cover assembly of the valve mechanism of FIG. 1.

Referring to FIG. 9, the fill cover assembly 92 of the valve mechanism can be provided to selectively seal the fill spout of the body. The fill cover assembly 92 can include a fill cover 240, a cover washer 242, a mounting screw 244, a mounting washer 246, a post 248, a cover bracket 250, a sleeve 252, a cover spring 254, and a retainer 256.

The post 248 includes an internal threading to threadingly engage the mounting screw 244, as shown in FIG. 5. The mounting screw 244 can retentively engage the post 248 with the mounting washer 246, the cover washer 242, and the fill cover 240 disposed therebetween. The cover bracket 250 includes a hole 260 for receiving a tip 262 of the post 248 therethrough. The retainer 256 can be mounted to the tip 262 of the post to fix the fill cover 240 to the cover bracket 250.

Referring to FIG. 9, the cover bracket 250 is generally L-shaped and can include a pair of arms 266 in spaced relationship to each other with the sleeve 252 extending therebetween. The sleeve 252 can be engaged with the fill cover support arms 220 of the body to define the fill cover axis 110 about which the cover bracket 250 can rotate, as shown in FIG. 5. The cover spring 254 can be axially disposed about the sleeve 252 such that a first end 268 of the spring 254 engages the valve body and a second end 269 of the spring 254 engages an upper surface 272 of the cover bracket 250 to bias the fill cover 240 to the closed position. With the fill cover assembly 92 in the closed position, the fill cover 240 and the cover washer 242 form a physical seal with the fill spout 180 of the valve body 132, as shown in FIG. 5.

Figure 10:
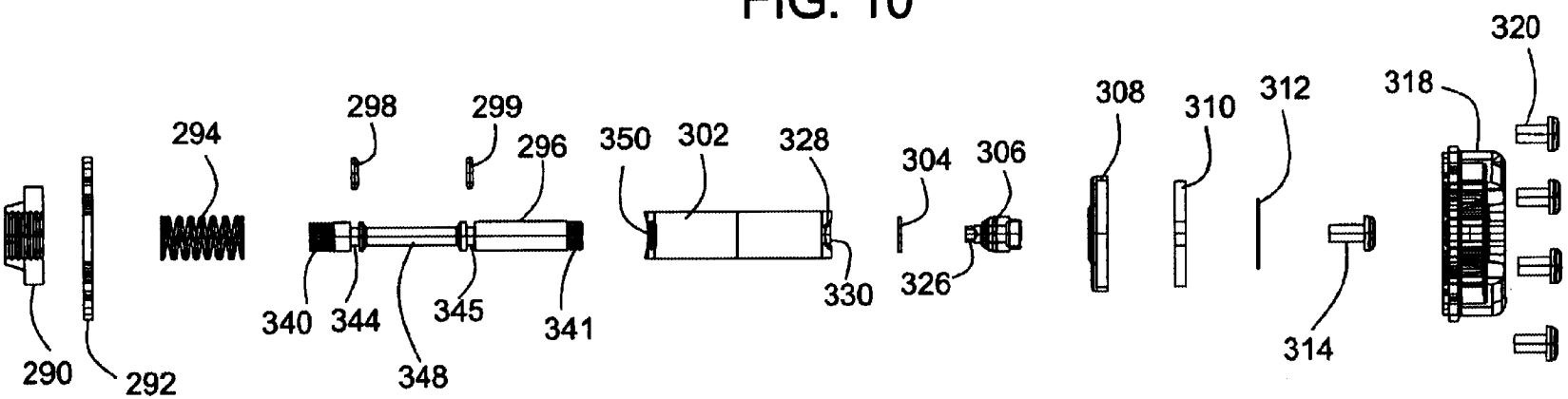
FIG. 10 is an exploded view of a pour valve assembly of the valve mechanism of FIG. 1.

Referring to FIG. 10, the pour valve assembly 94 of the valve mechanism can be provided to selectively seal the pour spout and the venting passage of the body. The pour valve assembly 94 can include an actuator 290, a body gasket 292, a pour valve spring 294, a slide shaft 296, a pair of shaft O-rings 298, 299, a slide ring 302, a washer 304, a post 306, a disc retainer 308, a pour valve gasket 310, a valve gasket washer 312, a valve gasket mounting screw 314, a seat 318, and a plurality of seat mounting screws 320.

Figure 18:
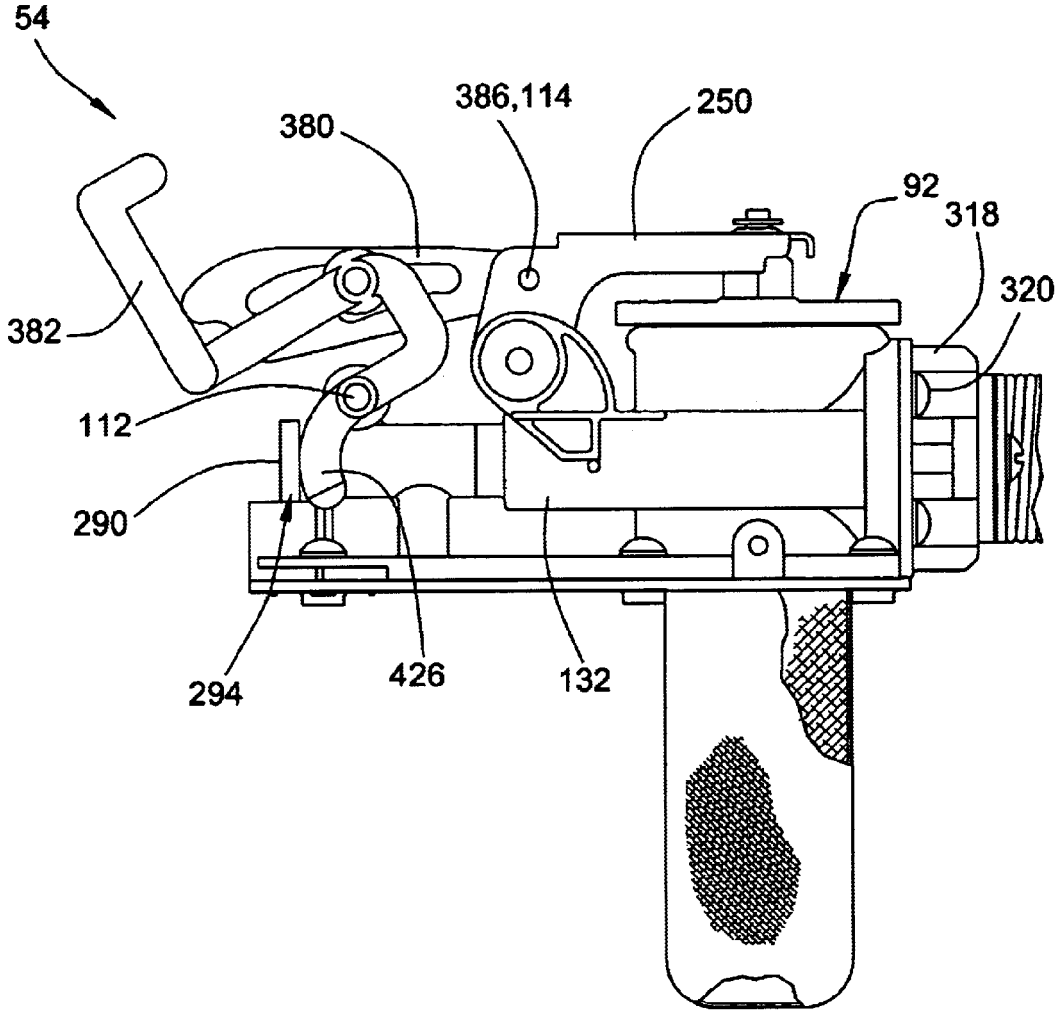
FIG. 18 is a side elevational view of the valve mechanism similar to FIG. 17 but with the handle removed for illustrative purposes.
Figure 19:
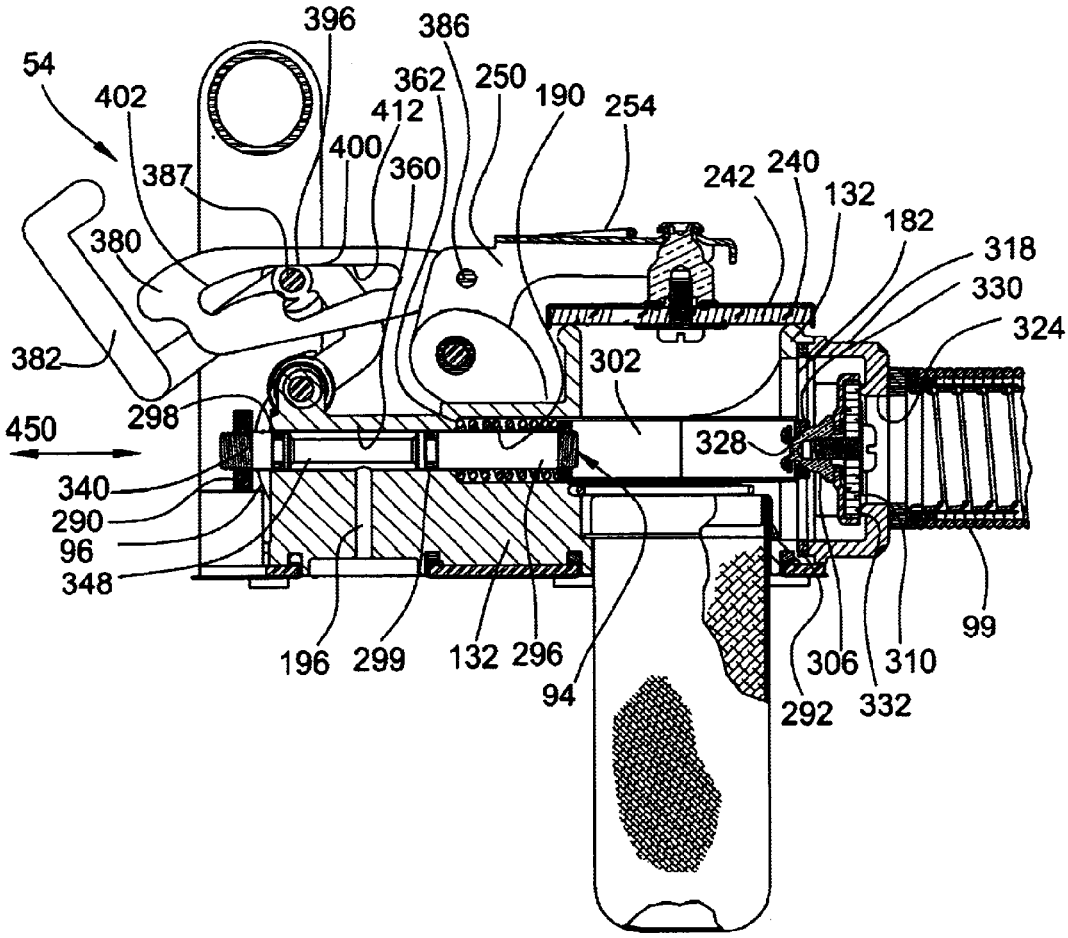
FIG. 19 is a view of the valve mechanism similar to FIG. 18, partially broken away for illustrative purposes.

Referring to FIG. 19, the seat 318 includes an aperture 324 therethrough which can be configured such that it communicates with the pour spout 182 and with the flex hose 99. The seat 318 can be mounted to the body 132 by the seat mounting screws 320, as shown in FIG. 18, with the body gasket 292 disposed therebetween.

Referring to FIG. 10, the valve gasket mounting screw 314 can threadingly engage an internal thread of the post 306 to retain the valve gasket mounting screw 314, the valve gasket washer 312, the valve gasket 310, the disc retainer 308, and the post 306. The post 306 can be pivotally mounted to the slide ring 302. A tip 326 of the post 306 can extend through an opening 328 in the slide ring 302. The washer 304 can be provided and mounted to the tip 326 to make the tip 326 larger than the opening 328 to retain the post 306 to the slide ring 302. A curved surface 330 of the opening 328 allows the post 306 to pivot with respect to the slide ring 302 to facilitate a sealing engagement between the valve gasket 310 and an inner surface 332 of the seat 318, as shown in FIG. 19.

Figure 11:
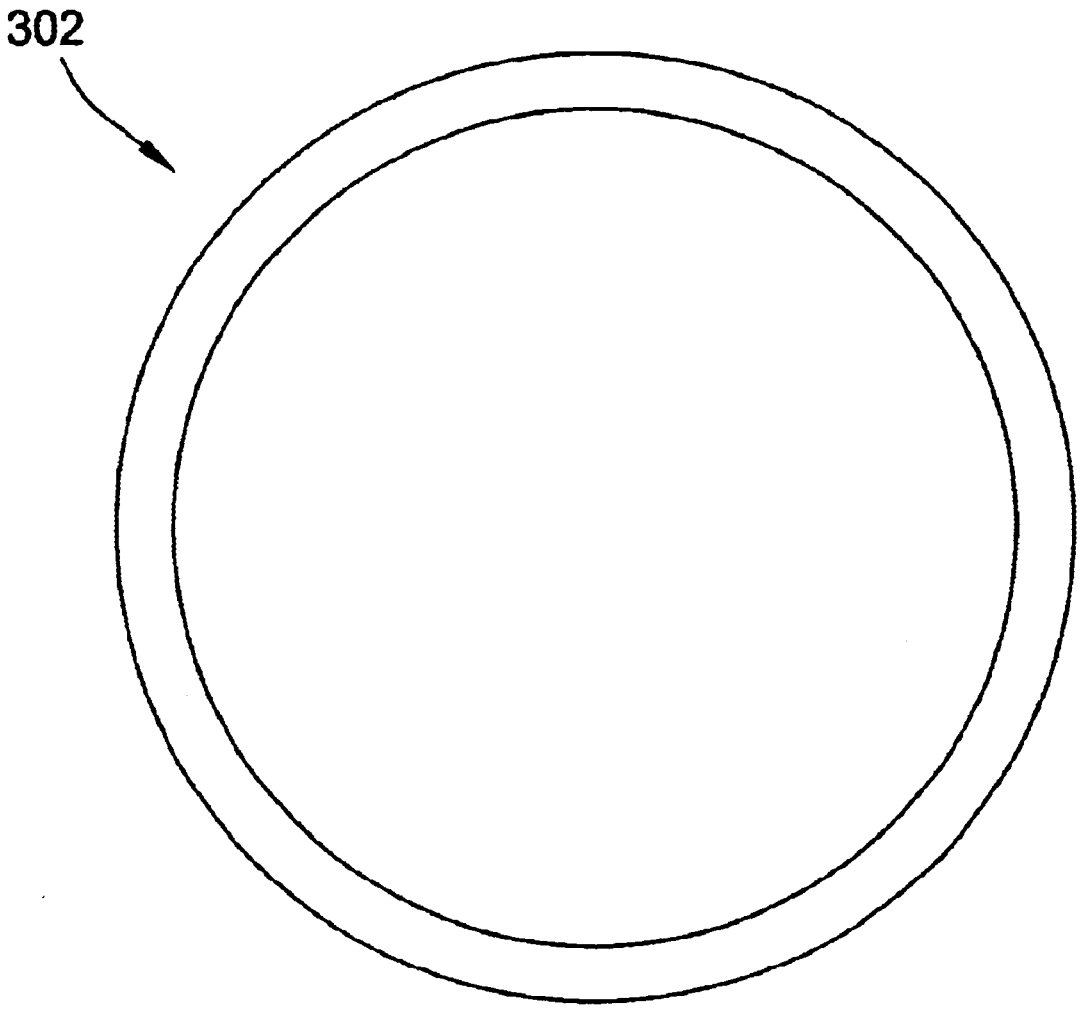
FIG. 11 is a top plan view of a slide ring of the pour valve assembly of FIG. 10.

Referring to FIG. 11, the slide ring 302 has a generally ring-shaped perimeter and is configured to be generally the same size as the diameter of the main passage of the valve body.

Referring to FIG. 10, the slide shaft 296 is generally cylindrical and can include a threaded portion at each end 340, 341 thereof. The slide shaft 296 can include a pair of annular grooves 344, 345 for receiving the shaft O-rings 298, 299, respectively. The slide shaft 296 includes an intermediate portion 348 with a reduced diameter relative to the remainder of the slide shaft 296. The intermediate portion 348 is disposed between the grooves 344, 345 for the O-rings 298, 299.

The second threaded end 341 can be threadingly engaged with a threaded shaft opening 350 of the slide ring 302. The pour valve spring 294 can be axially disposed on the slide shaft 296. The O-rings 298, 299 can be disposed in the grooves 344, 345, respectively, of the slide shaft 296. The actuator 290 can be threadingly engaged with the first threaded end 340 of the slide shaft 296.

Referring to FIG. 19, the pour valve passage 190 of the body 132 includes a narrowed portion 360 with a shoulder 362 joining the narrowed portion 360 to the remainder of the passage 190. The valve spring 294 can be disposed such that it is engaged between the shoulder 362 of the passage 190 and the slide ring 302 to effect a seal between the pour valve gasket 310 and the inner surface 332 of the seat 318. The reduced diameter portion 348 of the slide shaft 296 is disposed above the vent passage 196 of the body 132. The O-rings 298, 299 are in sealing engagement with the narrowed portion 360 of the valve passage 190 and are disposed on either side of the vent passage 196 to selectively provide a seal between the vent passage 196 and the outside and a seal between the vent passage 196 and the main passage 184, respectively. The first threaded end 340 of the slide shaft extends from the body 132. The actuator 290 of the pour valve assembly 94 is engaged with the trigger assembly 96.

Figure 12:
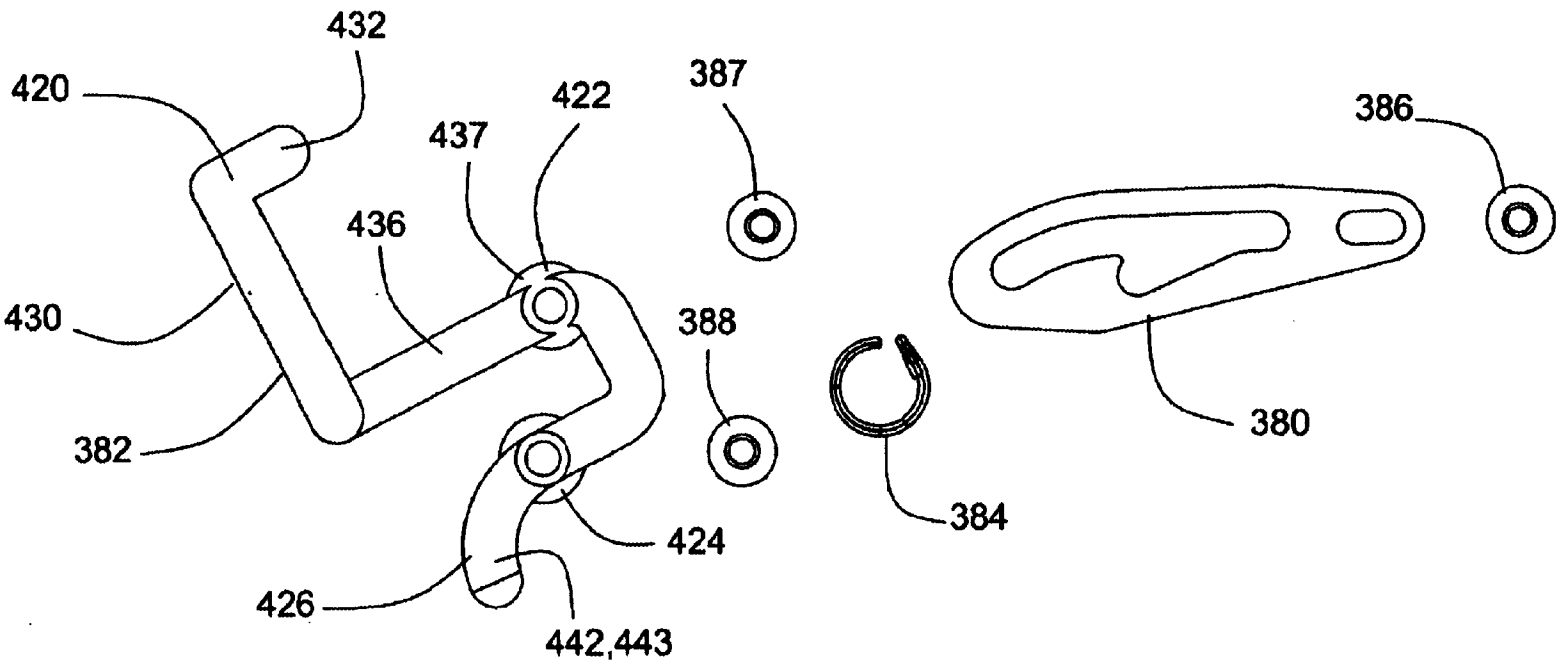
FIG. 12 is an exploded view of a trigger assembly of the valve mechanism of FIG. 1.

Referring to FIG. 12, the trigger assembly 96 of the valve mechanism can be provided to selectively operate the fill cover and the pour valve. The trigger assembly 96 can include a connecting link 380, a trigger 382, a trigger spring 384, and a plurality of rivets 386, 387, 388.

Figure 13:
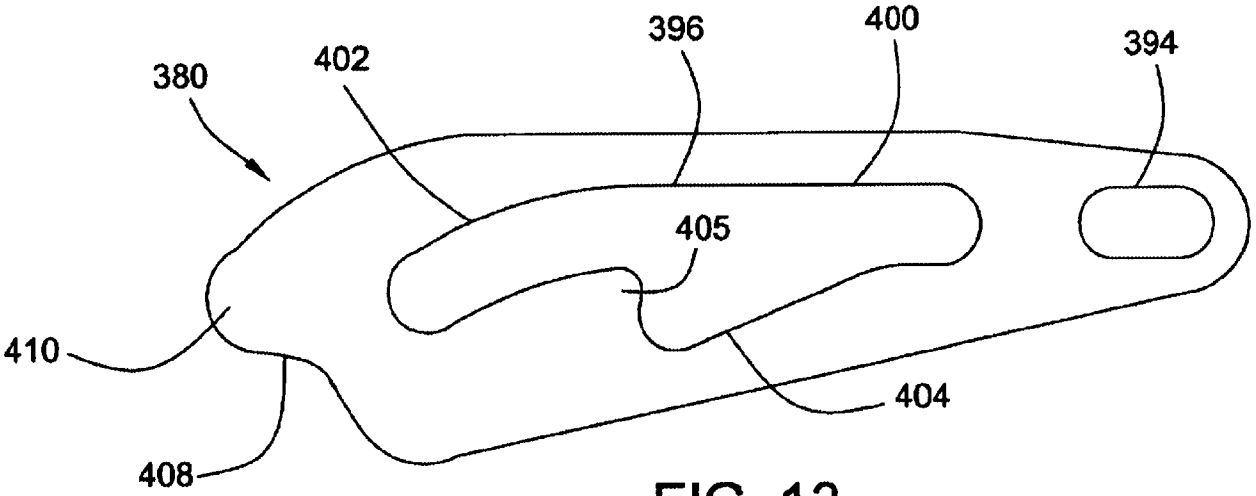
FIG. 13 is a side elevational view of a connecting link of the trigger assembly of FIG. 12.

Referring to FIG. 13, the connecting link 380 of the trigger assembly includes a bracket slot 394 and a trigger channel 396. The bracket slot 394 is an elongated opening which is configured to receive the link rivet 386 therethrough, as shown in FIG. 18, to define the connecting link axis 114. The link rivet 386 pivotally mounts the connecting link 380 to the cover bracket 250. Referring to FIG. 13, the bracket slot 394 allows the connecting link to translate with respect to the cover bracket over a range of travel defined by the size of the bracket slot 394.

The trigger channel 396 includes a generally linear pour portion 400, a generally curved safety portion 402, and a fill portion 404 which is inclined with respect to the pour portion 400. The fill portion 404 includes a shoulder 405. The connecting link 380 includes a distal end portion 408 which includes a protrusion 410 to facilitate the convenient gripping thereof by a user to selectively pivot the connecting link about the connecting link axis.

Figure 14:
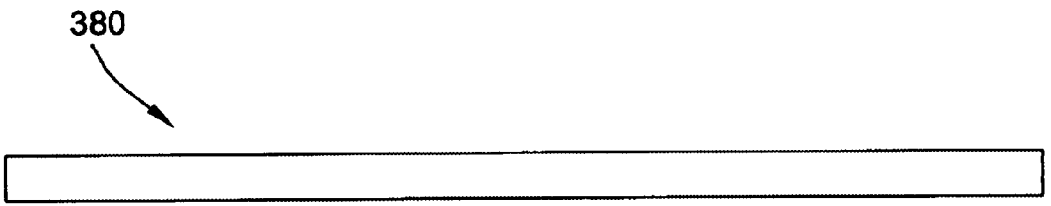
FIG. 14 is a top plan view of the connecting link of FIG. 13.

Referring to FIG. 14, the connecting link 380 is generally planar.

Figure 15:
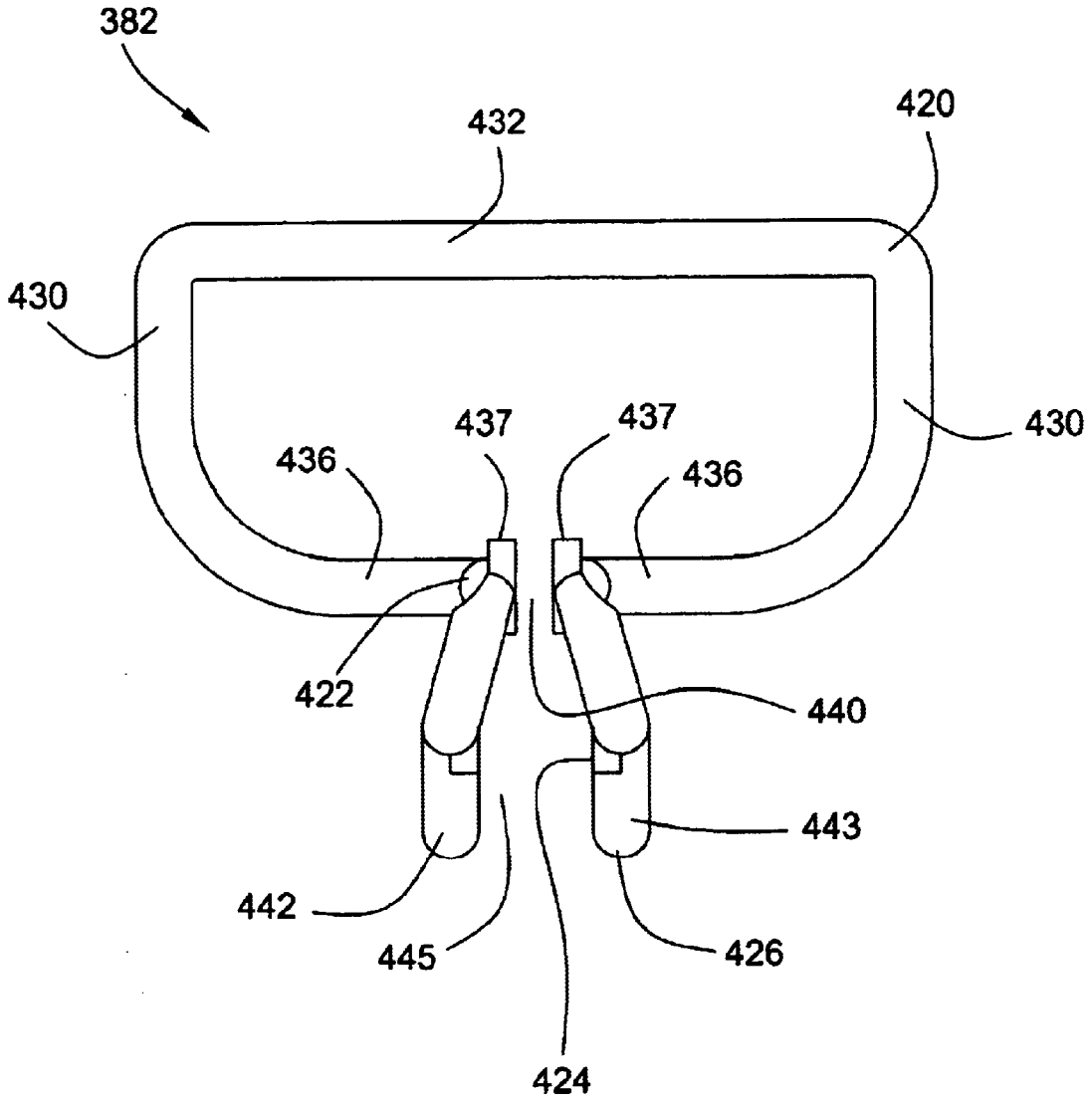
FIG. 15 is an end elevational view of a trigger of the trigger assembly of FIG. 12.

Referring to FIGS. 12 and 15, the trigger 382 includes an operating portion 420, a connecting link portion 422, a pivot 424, and a pour valve end 426. The operating portion 420 includes a pair of arms 430 and a connecting member 432 which can be sized for convenient gripping by a user, as shown in FIG. 1, as well. The connecting link portion 422 includes a pair of supports 436 each with a proximal end 437 configured to receive the link rivet 387 therethrough. The rivet 387 can extend between the supports 436 through the trigger channel 396, as shown in FIG. 1, and act as a connecting rod. Referring to FIG. 15, the proximal ends 437 define a gap 440 therebetween which can accommodate the connecting link.

The pour valve end 426 of the trigger 382 is curved and includes a pair of projections 442, 443 which define a space 445 therebetween to accommodate the trigger support of the body.

Referring to FIG. 19, the connecting link 380 can be supported by the link rivets 386, 387 such that the link rivet 387 in the trigger channel 396 normally bears against an upper edge 412 thereof.

Figure 22:
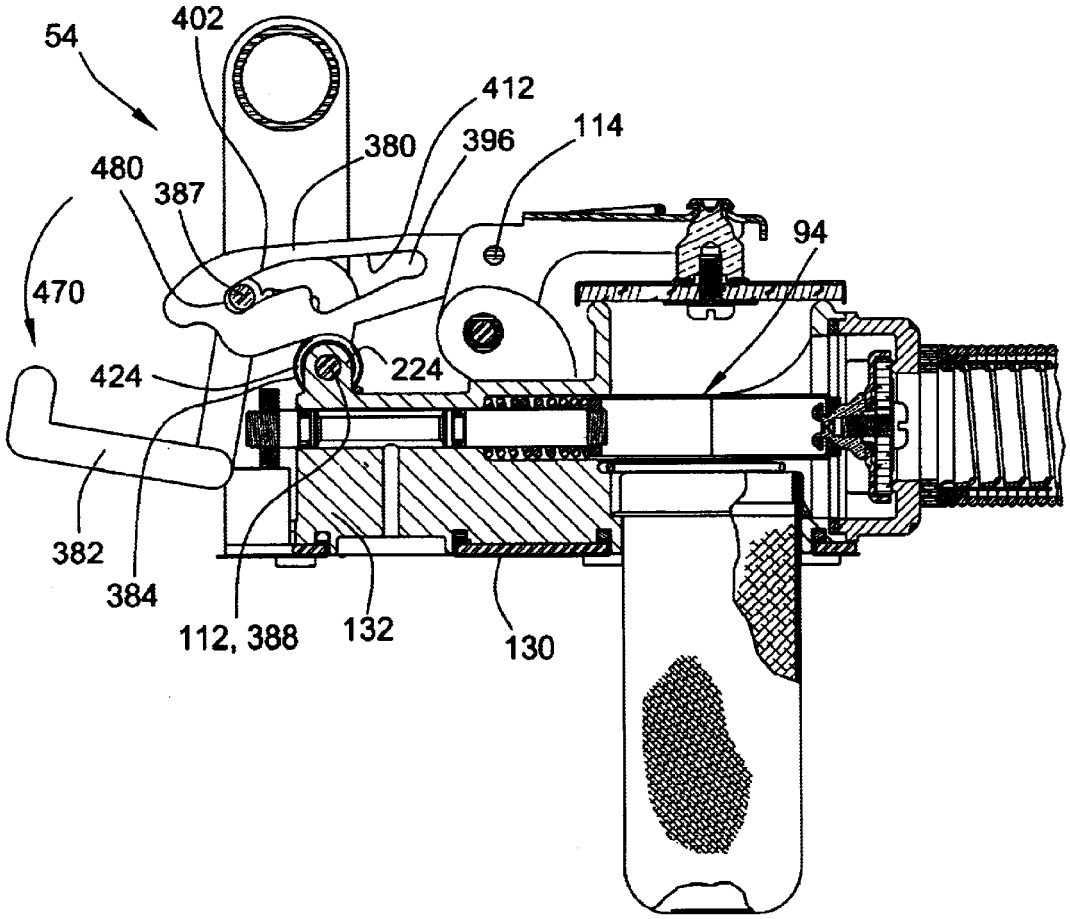
FIG. 22 is a side elevational view of the valve mechanism similar to FIG. 21, partially broken away for illustrative purposes.

Referring to FIG. 22, the pivot 424 can straddle the trigger support 224 and receive another rivet 388 which can extend through the trigger support 224 of the body 132 to define the trigger axis 112. The trigger spring 384 can be axially disposed on the pivot rivet 388. The trigger spring 384 can be provided to bias the trigger 382 toward a normal position, as shown in FIG. 18. Referring to FIG. 18, pivoting the trigger 382 about the trigger axis 112 in either direction can stretch the spring to create a return force which in turn can act to urge the trigger 382 to return to the normal position.

The pour valve end 426 of the trigger 382 is configured to engage the actuator 290 of the pour valve assembly 94. The end 426 of the trigger is disposed between the actuator 290 and the body 132. The trigger 382 can apply a force along a line of action that is substantially parallel to a longitudinal axis 450 of the slide shaft 296 to prevent binding of the trigger 382, as shown in FIG. 19.

Figure 16:
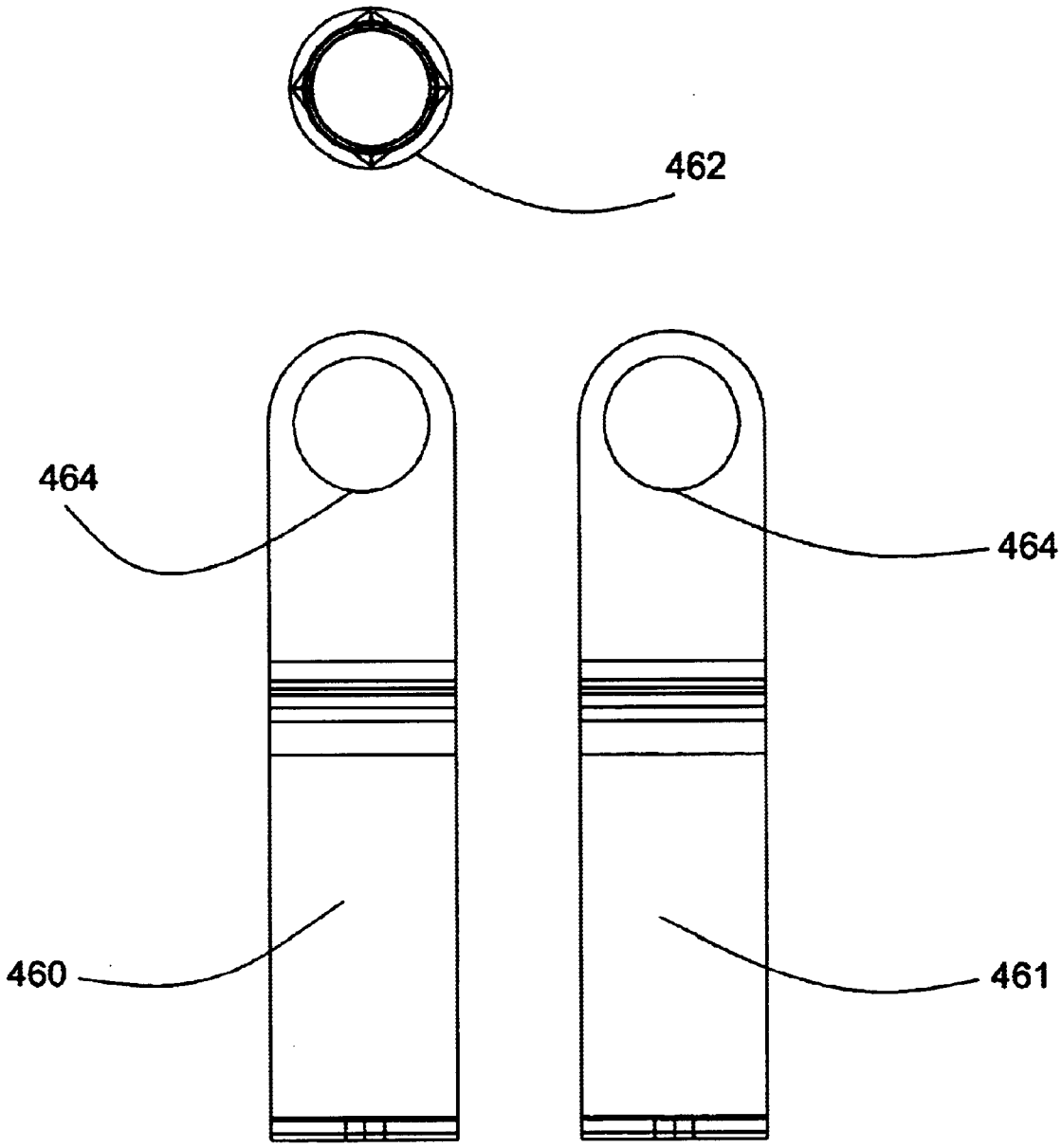
FIG. 16 is an exploded view of a handle of the valve mechanism of FIG. 1.
Figure 17:
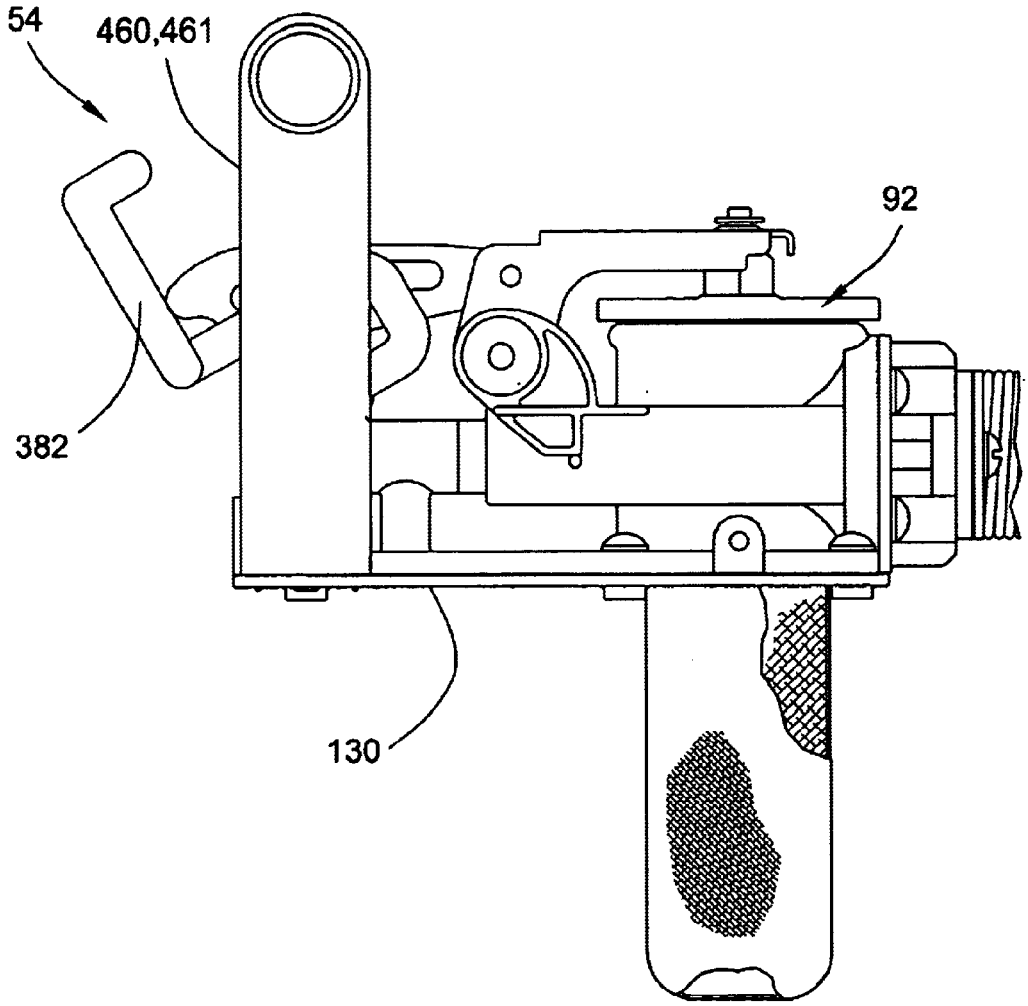
FIG. 17 is a side elevational view of the valve mechanism of FIG. 1, illustrating the valve mechanism in a normal position.

Referring to FIG. 16, the handle 98 of the valve mechanism can include a pair of handle straps 460, 461 and a sleeve 462. The sleeve 462 can extend between the handle straps 460, 461. Each handle strap 460, 461 includes a hole 464 to receive the sleeve therein. Referring to FIG. 17, the handle straps 460, 461 can be mounted to the mounting plate 130 of the body assembly 90.

Referring to FIGS. 17–19, the valve mechanism 54 of the safety can is shown in a normal position. Referring to FIGS. 17 and 18, the trigger 382 is in the normal position. The fill cover assembly 92 is in the closed position.

Referring to FIG. 19, the cover spring 254 acts upon the cover bracket 250 which in turn acts to place the fill cover washer 242 in sealing engagement with the fill spout 180 of the body 132. The cover spring 254 can be configured such that in the event that pressure within the chamber of the receptacle increase over a predetermined value, 5 psi, for example, the spring can flex in response to the pressure applied to the fill cover 240 to thereby open the fill cover to regulate the pressure within the chamber.

The pour valve assembly 94 is in the closed position such that fluid is prevented from being dispensed from the receptacle.

The link rivet 387 is disposed in an intermediate position of the trigger channel 396 between the pour portion 400 and the safety portion 402. The link rivet 387 is resting against the upper edge 412 of the trigger channel 396.

Figure 20:
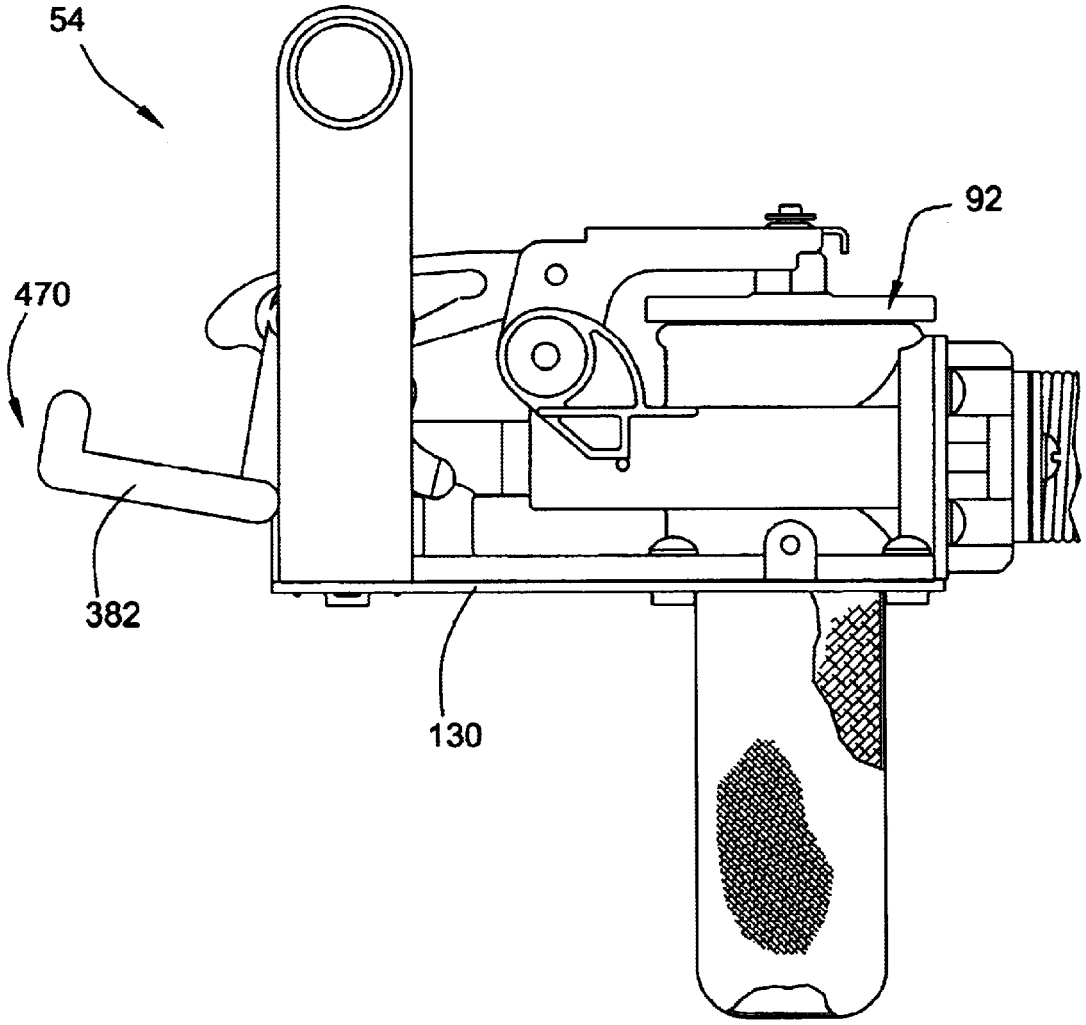
FIG. 20 is a side elevational view of the valve mechanism similar to FIG. 17, but illustrating the valve mechanism in a safety position.
Figure 21:
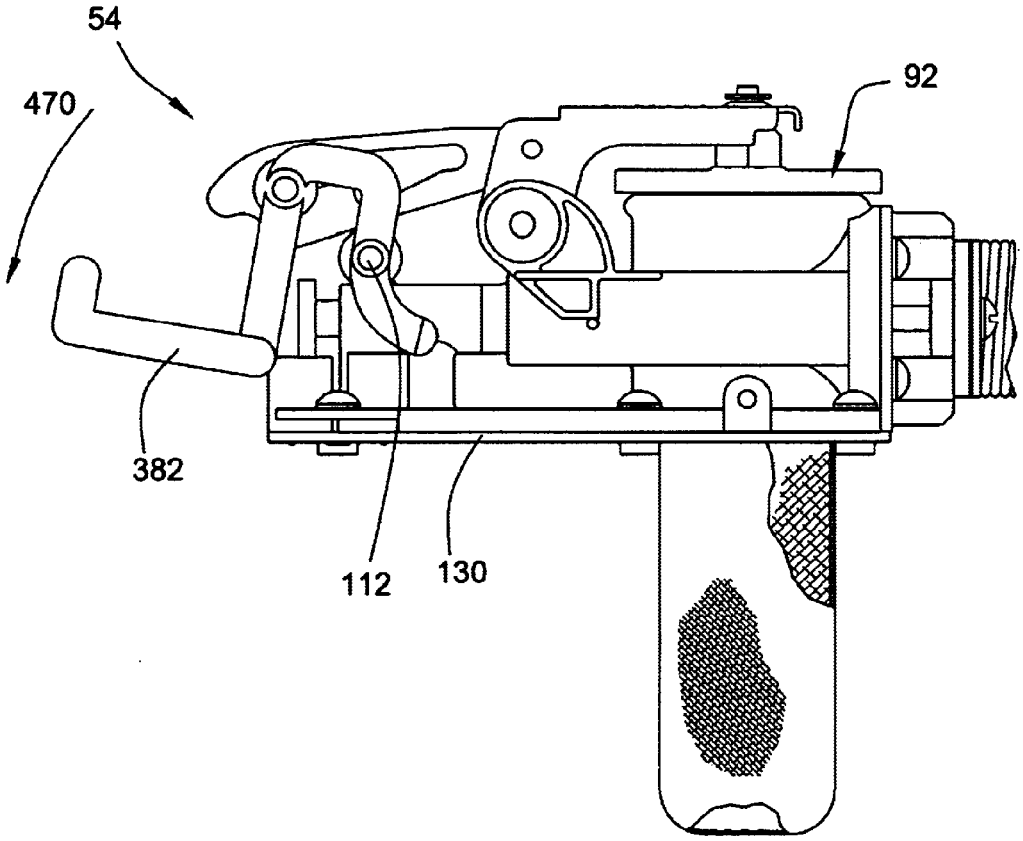
FIG. 21 is a side elevational view of the valve mechanism similar to FIG. 20 but with the handle removed for illustrative purposes.

Referring to FIGS. 20–22, the valve mechanism 54 of the safety can 50 is shown in a safety position. Referring to FIGS. 20 and 21, the trigger 382 is in a depressed position such that the trigger 382 has been moved about the trigger axis 112 in a depressing direction 470 toward the mounting plate 130. The fill cover assembly 92 is in the closed position.

Referring to FIG. 22, the trigger spring 384 is flexed such that it is imparted with a return force which can act to urge the trigger to return to the normal position. The link rivet 387 is disposed at an end 480 of the safety portion 402. The connecting link 380 has rotated about the connecting link axis 114 in the depressing direction 470 from a normal position toward the mounting plate 130. The link rivet 387 is resting against the upper edge 412 of the trigger channel 396. The pour valve assembly 94 is in the closed position such that fluid is prevented from being dispensed from the receptacle.

The trigger mechanism is configured to move freely downward toward the can without opening the cover and return to its normal position via the action of the trigger spring in the event that the trigger is unintentionally moved. The valve mechanism 54 can be placed in one of a range of safety positions wherein neither the fill cover assembly nor the pour valve assembly is in an open position. The ability to be placed in a safety position helps to prevent the unintentional opening of the fill cover assembly.

Figure 24:
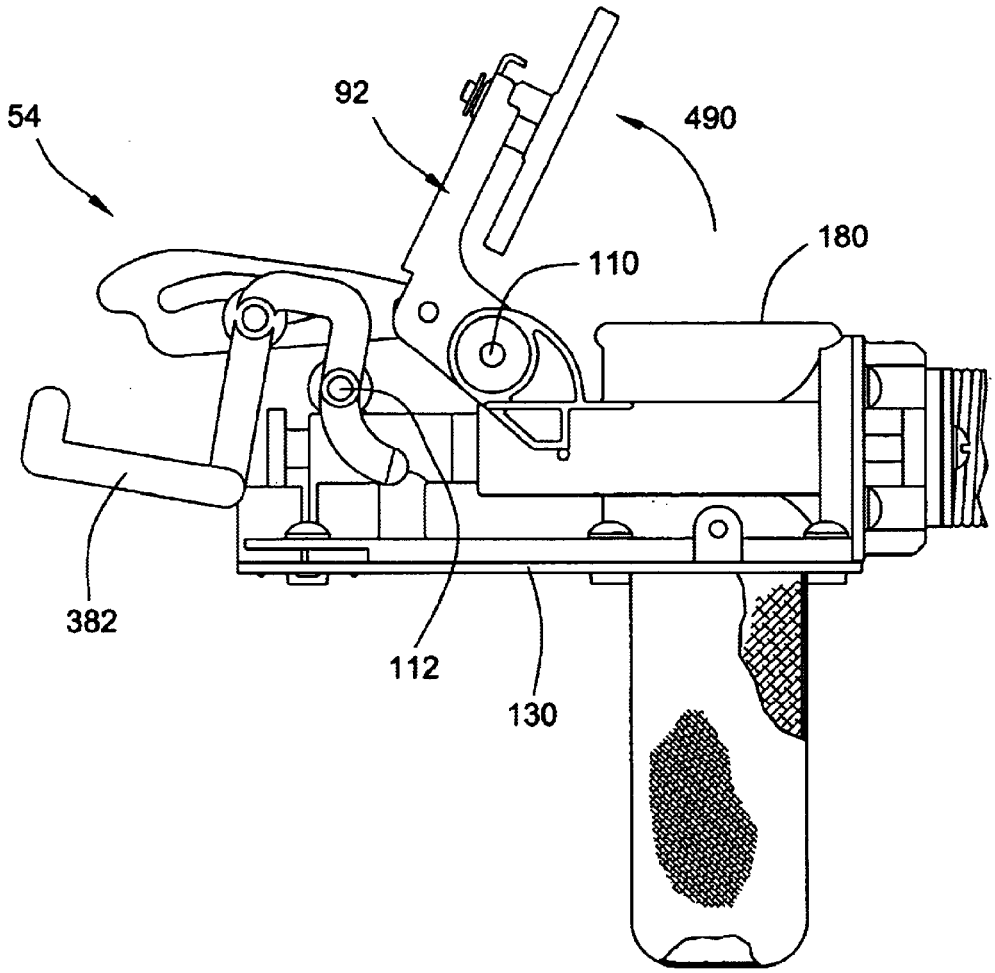
FIG. 24 is a side elevational view of the valve mechanism similar to FIG. 23 but with the handle removed for illustrative purposes.
Figure 25:
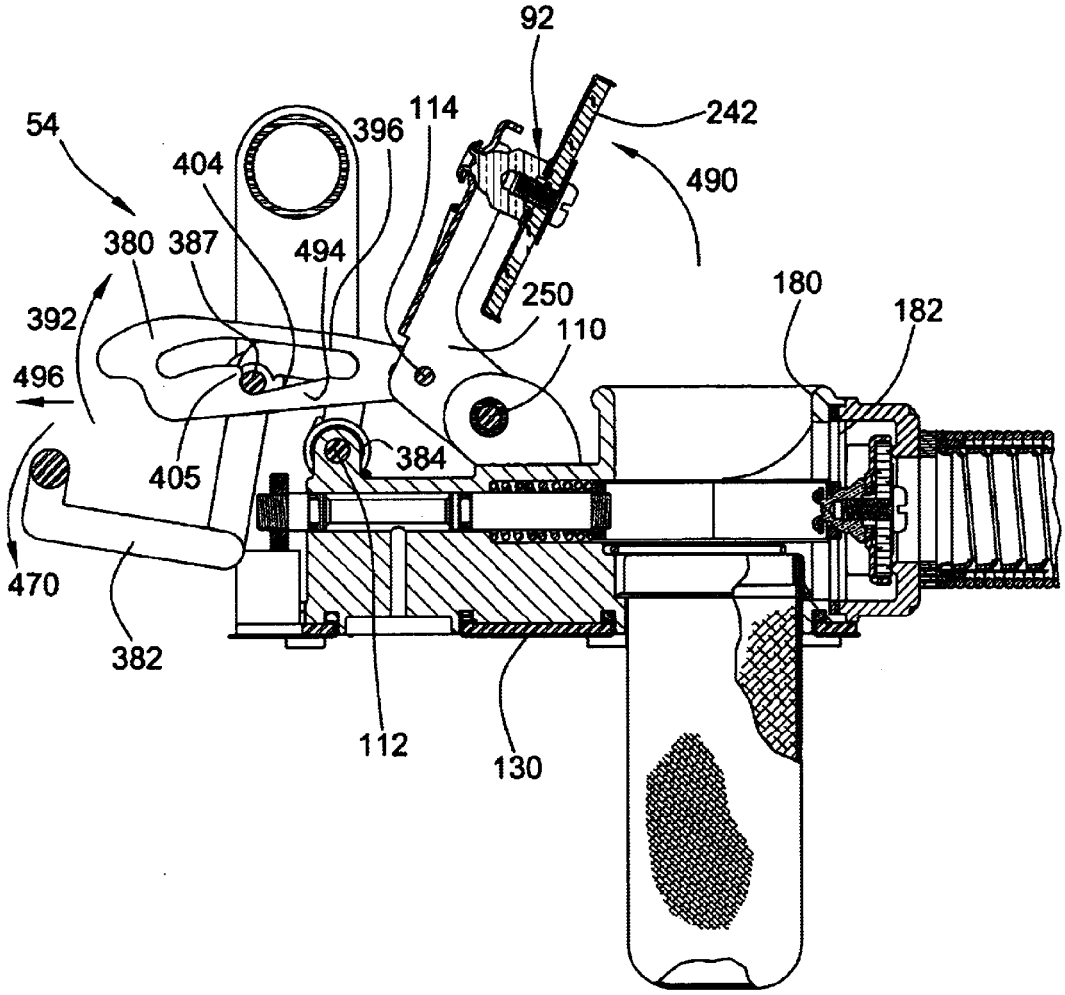
FIG. 25 is a side elevational view of the valve mechanism similar to FIG. 24, partially broken away for illustrative purposes.

Referring to FIGS. 23–25, the valve mechanism 54 of the safety can is shown in a fill position. Referring to FIGS. 23 and 24, the trigger 382 is in a depressed position such that the trigger 382 has been moved about the trigger axis 112 in the depressing direction 470 toward the mounting plate 130. The fill cover assembly 92 has moved in an opening direction 490 about the fill cover axis 110 to an open position. The fill spout 180 can be accessed to fill the receptacle.

Referring to FIG. 25, the trigger spring 384 is flexed such that it is imparted with a return force which can act to urge the trigger 382 to return to the normal position. The link rivet 387 is disposed at the shoulder 405 of the fill portion 404. The connecting link 380 has rotated about the connecting link axis 114 in a lifting direction 492 from a normal position away from the mounting plate 130 to engage the shoulder 405 and the link rivet 387. The link rivet 387 is resting against a lower edge 494 of the trigger channel 396. The trigger 382 has been rotated about the trigger axis 112 in the depressing direction 470 which caused the connecting link 380 to move in a retracting direction 494, which in turn caused the cover bracket 250 to rotate about the fill cover axis 110 in the opening direction 490 so that the fill cover washer 242 disengaged the fill spout 180 to permit filling of the receptacle.

The pour valve assembly 94 is in the closed position such that fluid is prevented from being dispensed from the receptacle.

When fill cover assembly 92 is in the open position, the atmosphere inside the container is open to the outside atmosphere through the fill spout 180 alone which can allow for efficient and clean filling of the container therethrough with the pour spout 182 sealed.

Figure 26:
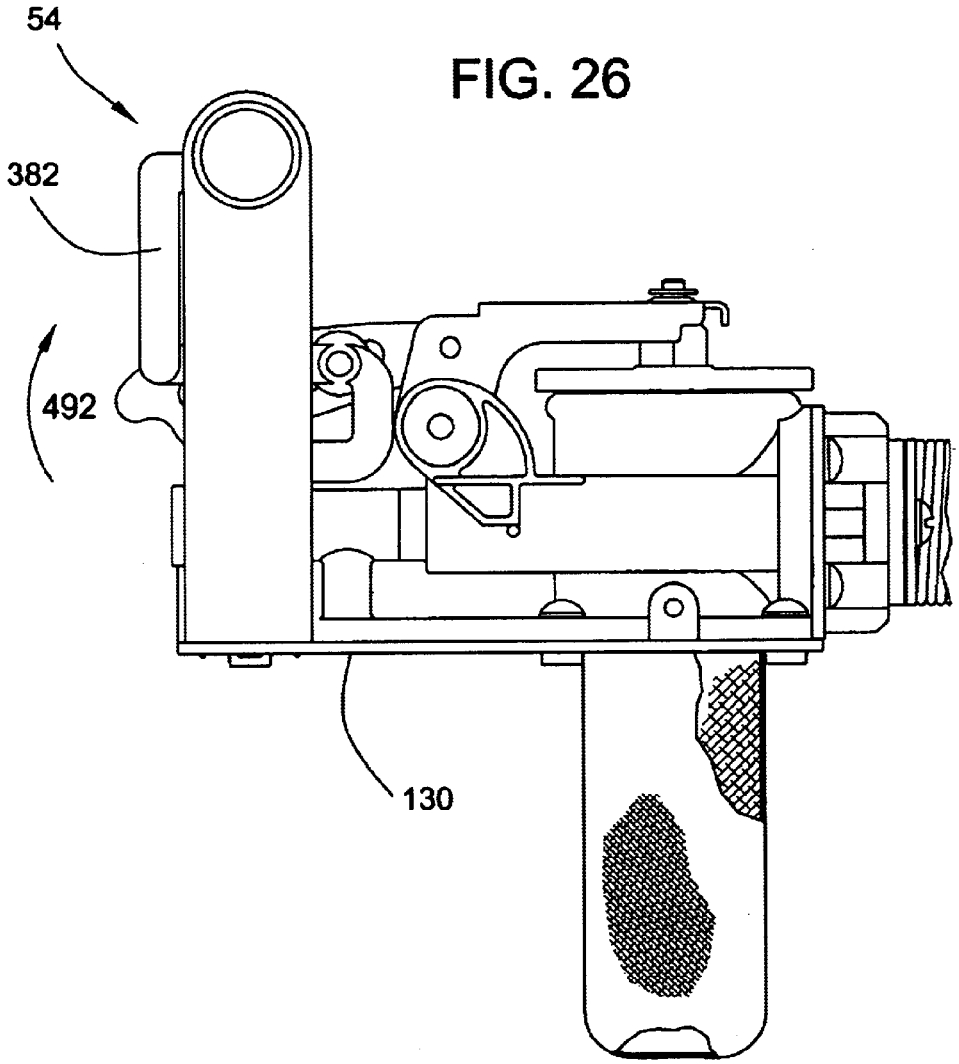
FIG. 26 is a side elevational view of the valve mechanism similar FIG. 14, but illustrating the valve mechanism in a pour position.
Figure 27:
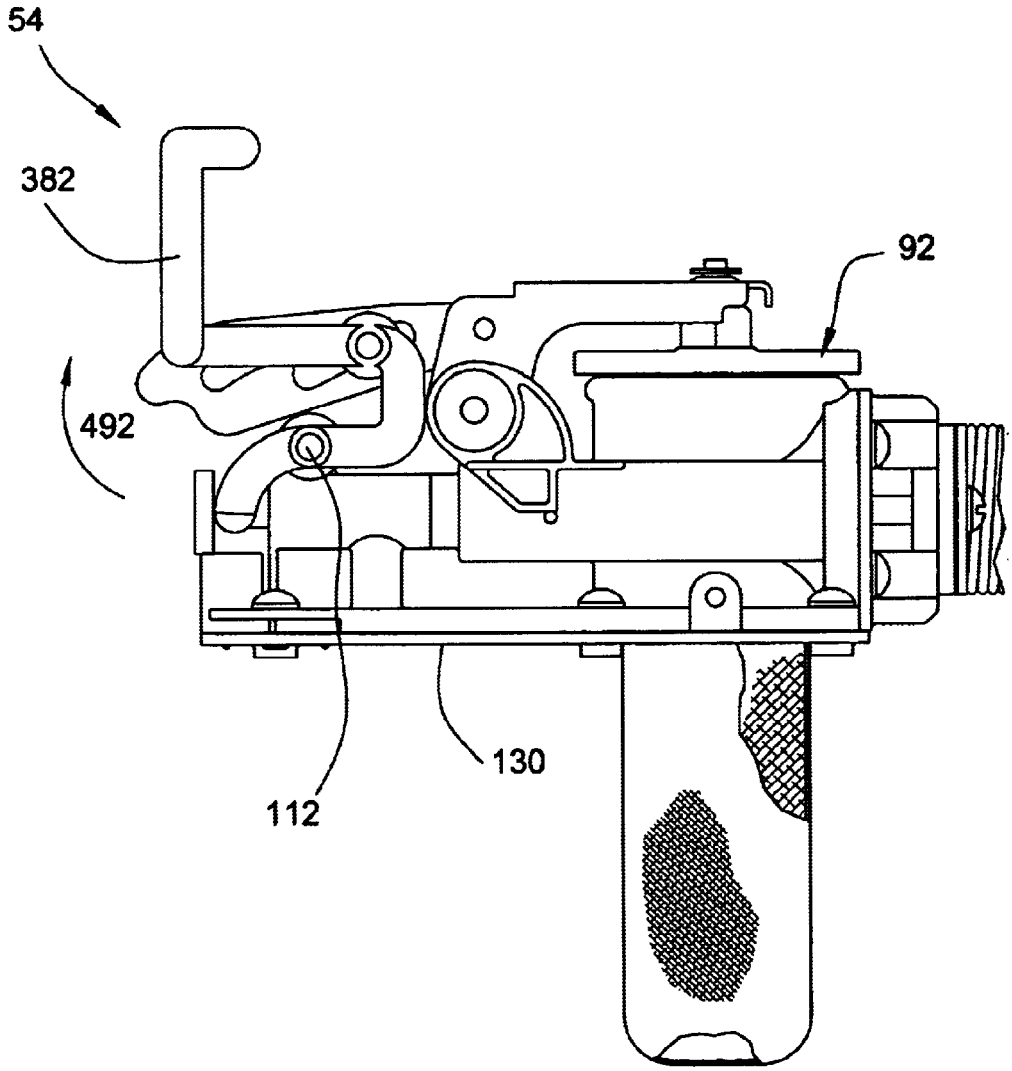
FIG. 27 is a side elevational view of the valve mechanism similar to FIG. 26 but with the handle removed for illustrative purposes.

Referring to FIGS. 26–28, the valve mechanism 54 of the safety can is shown in a pour position. Referring to FIGS. 26 and 27, the trigger 382 is in a lifted position such that the trigger 382 has been moved about the trigger axis 112 in the lifting direction 492 away from the mounting plate 130. The fill cover assembly 92 is in the closed position.

Referring to FIG. 28, the trigger spring 384 is flexed such that it is imparted with a return force which can act to urge the trigger 382 to rotate in the depressing direction 470 about the trigger axis 112 to return to the normal position. The link rivet 387 is disposed adjacent an end 498 of the pour portion 400. The link rivet 387 is resting against the upper edge 412 of the trigger channel 396.

The pour valve assembly 94 is in the open position such that fluid can be dispensed from the receptacle. The pour valve end 426 of the trigger 382 has moved the actuator 290 of the pour valve assembly 94 in the retracting direction 496 to open the pour valve assembly. The pour valve gasket 310 is disengaged from the inner surface 332 of the seat 318 to allow liquid stored within the receptacle to be dispensed therefrom through the hose attachment 99.

The valve mechanism 54 includes a concerted venting system which operates to vent the receptacle when the valve mechanism is in the pour position. As shown in FIG. 28, the first O-ring 298 disposed on the slide shaft 296 of the pour valve assembly 94 is disengaged from the narrowed portion 360 of the pour valve passage 190 of the body 132, thereby defining a vent path between the outside environment and the receptacle for venting of the receptacle. The vent path extends between the vent opening 198 through the vent passage 196 and the narrowed portion 360 of the pour valve passage 190 to the rear opening 204. The first O-ring 298 is disposed outside of the valve body 132 when the pour valve assembly 94 is in the open position. The second O-ring 299 seals the narrowed portion such that the vent path leads to the receptacle and does not include the other portion of the valve passage 190.

To pour liquid from the container, a user can grasp the handle 98 with one hand, lift the can, and grasp the base of the receptacle with the other hand. The fingers of the hand holding the handle can grasp the trigger 382 to move it toward the handle 98 in the lifting direction 492. The action of moving the trigger 382 toward the handle 98 causes the pour valve end 426 of the trigger 382 to push tangentially on the actuator 290 such that the actuator 290 moves away from the valve body 132 in the retracting direction 496. Movement of the actuator 290 in turn moves the remainder of the pour valve assembly away from the seat 318, thereby compressing the valve spring 294 to develop a return biasing force that can act to urge the gasket 310 toward the seat 318 and opening the valve to allow liquid to flow therethrough while simultaneously venting the can.

The container can automatically vent as the trigger 382 is squeezed. The flow of fluid from the safety can may be regulated by moving the trigger 382 toward the handle 98 in the lifting direction 492 to increase flow and by allowing the trigger spring 384 to move the trigger 382 away from the handle 98 in the depressing direction 470 to reduce flow. Once the desired amount of fluid is dispensed from the container, the trigger 382 can be released to close the pour spout 182, thereby stopping the flow of fluid from the container completely. The valve spring 294 can act to urge the gasket 310 to move toward the seat 318.

Figure 29:
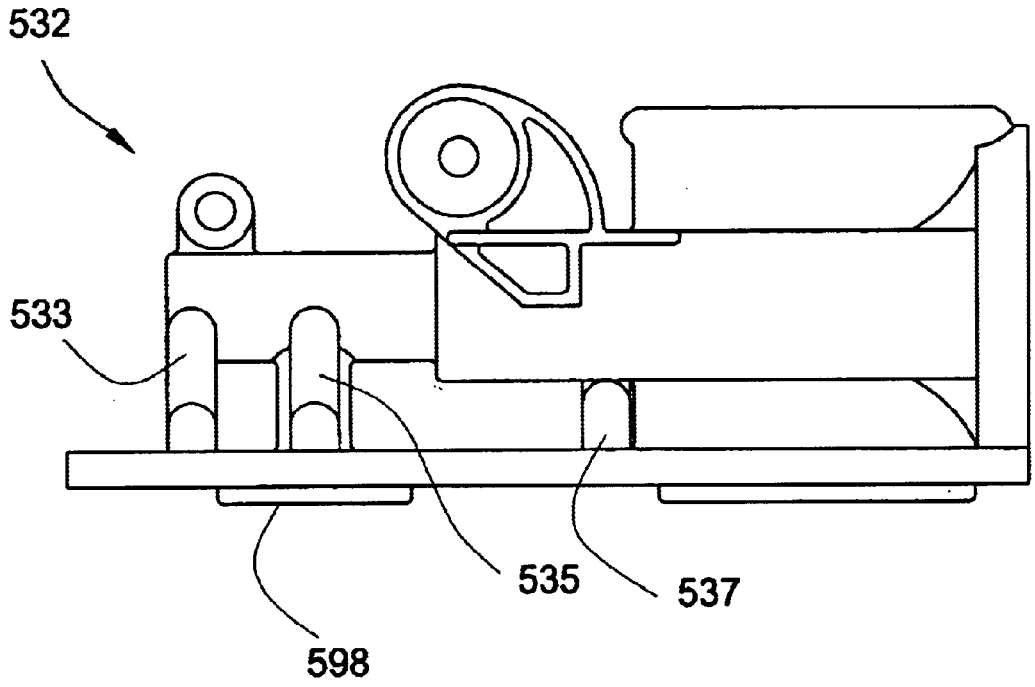
FIG. 29 is a side elevational view of another embodiment of a valve body useful in connection with the present invention.

Referring to FIG. 29, another embodiment of a valve body 532 useful in connection with the present invention is shown. The valve body 532 includes a plurality of ribs 533, 535, 537 disposed to provide structural rigidity to the valve body 532. The ribs can be disposed on both sides of the valve body 532. The first and third ribs 533, 535 can be disposed adjacent the location of the mounting screws used to secure the valve body to a mounting plate. The second ribs 535 can be aligned with the vent opening 598 of the valve body 532. The valve body 532 is similar in other respects to the valve body 132 shown in FIG. 1.

Figure 30:
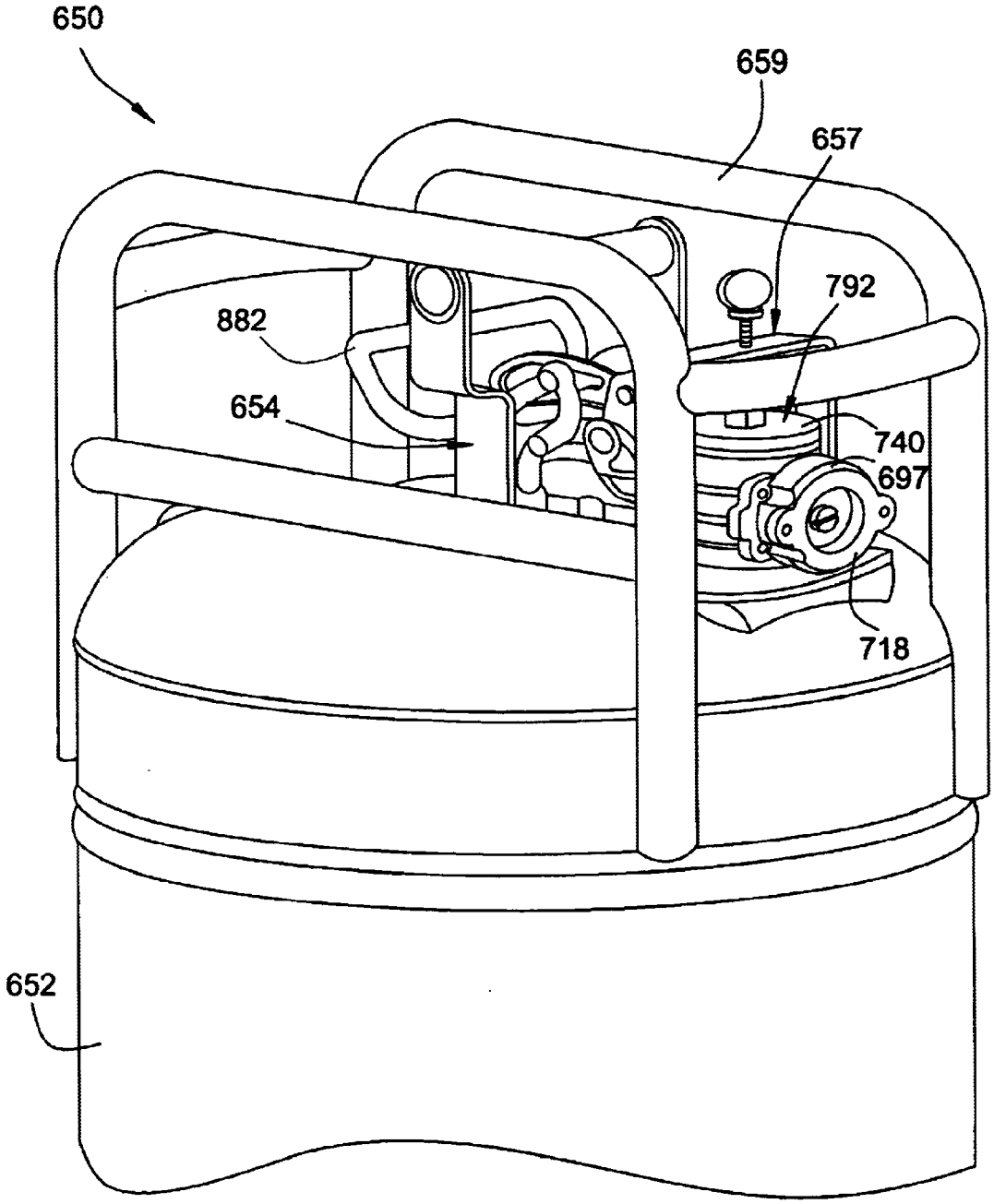
FIG. 30 is a perspective view of another embodiment of a safety can according to the present invention including a clamp and a cage.

Referring to FIG. 30, another embodiment of a safety can 650 according to the present invention is shown, which includes a clamp assembly 657 and a cage 659. The cage can be mounted to the receptacle 652. The clamp assembly 657 can be mounted to the valve mechanism 654.

Figure 31:
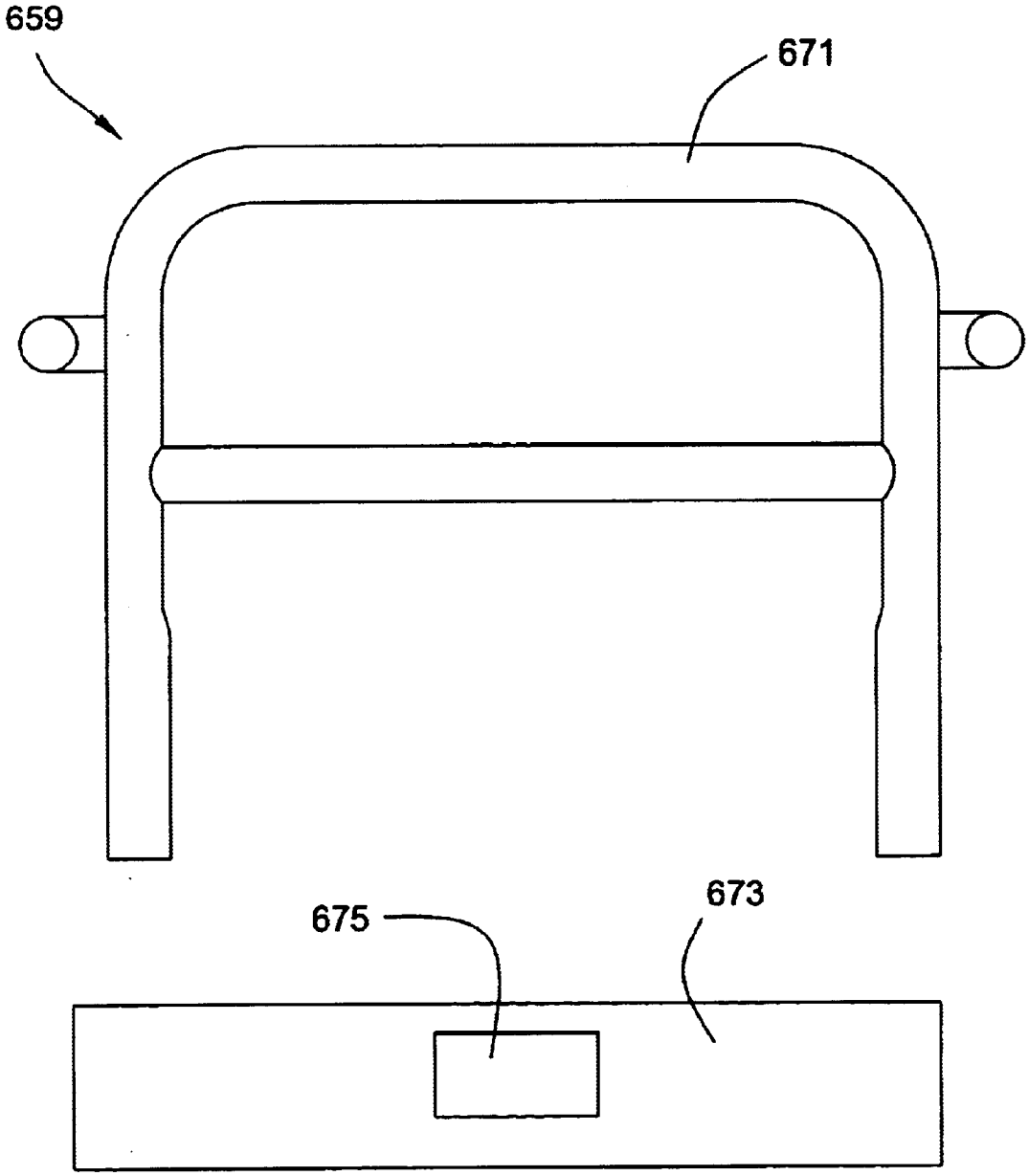
FIG. 31 is an exploded view of the cage of the safety can of FIG. 30.

Referring to FIG. 31, the cage 659 can be provided to protect the valve mechanism from harm in the event the safety can is dropped or otherwise suffers an impact. The cage 659 includes a frame 671 and a band 673. The band 673 can be mounted to the side wall portion of the receptacle. The band 673 can include an area 675 for displaying indicia. The frame 671 can be mounted to the band 673.

Figure 32:
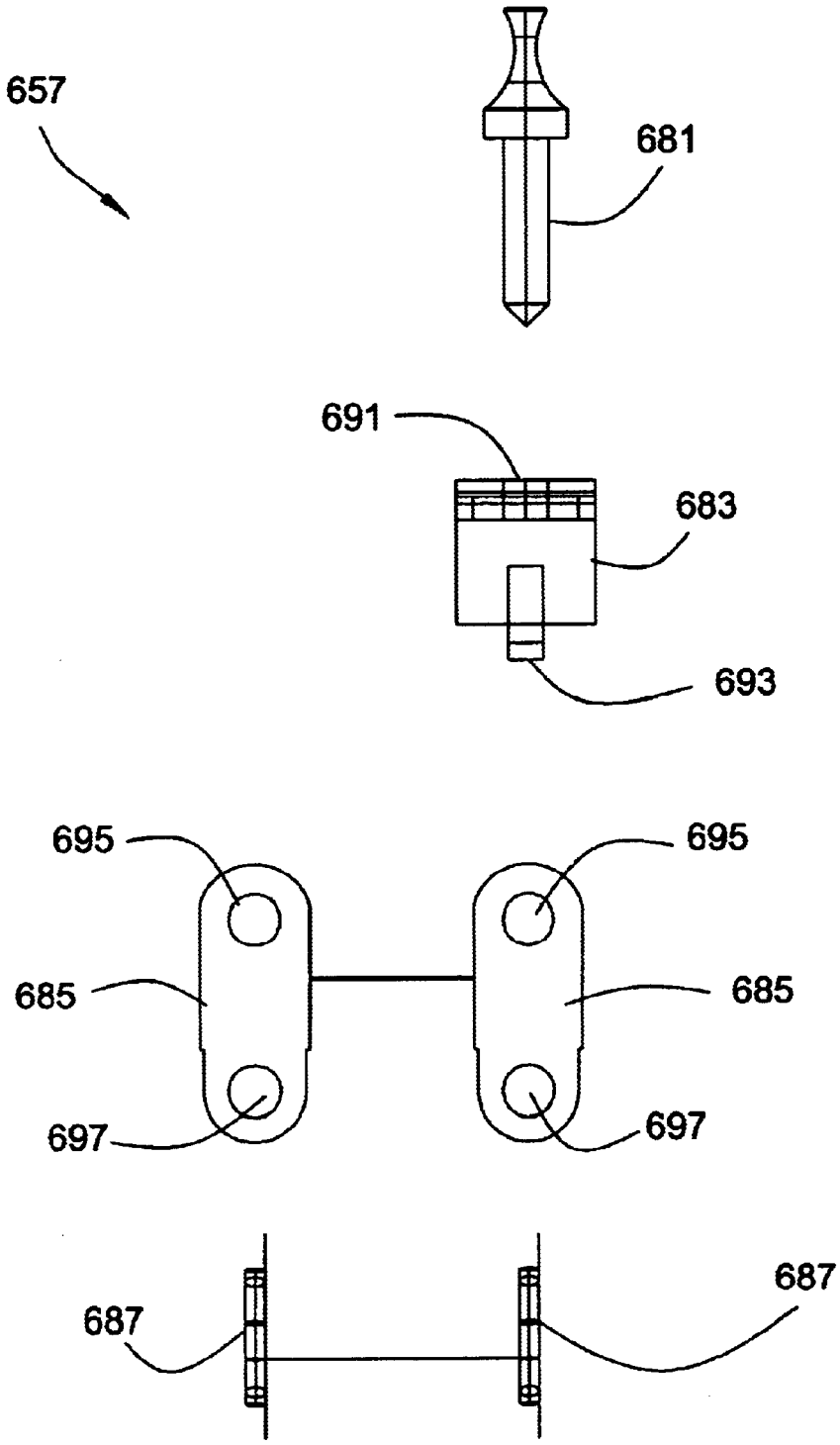
FIG. 32 is an exploded view of the clamp of the safety can of FIG. 30.

Referring to FIG. 32, the clamp assembly 657 can be included to provide an additional safety feature to prevent the unintentional opening of the fill cover assembly. The clamp assembly 657 can include a thumbscrew 681, a cover hold-down bracket 683, a pair of fusible links 685, and a pair of S-hooks 687. The cover hold-down bracket 683 includes a threaded opening 691 therein to threadingly retain the thumbscrew 681 and a pair of tabs 693 for respectively mounting the fusible links 685 thereto about a first opening 695 thereof. One end of the S-hooks 687 can be respectively attached to the fusible links 685 by operative engagement with a second opening 697 of the fusible links 685. The mounting plate can include a pair of ears 695, as most clearly shown in FIG. 6, for respectively securing the other end of the S-hooks thereto.

Each fusible link can be made from a plurality of portions that are soldered together, for example. The fusible links 685 can be constructed such that they will fuse when the ambient temperature is above a selected temperature, 165° F., for example, to thereby sever the link such that the clamp assembly 657 is detached.

Figure 33:
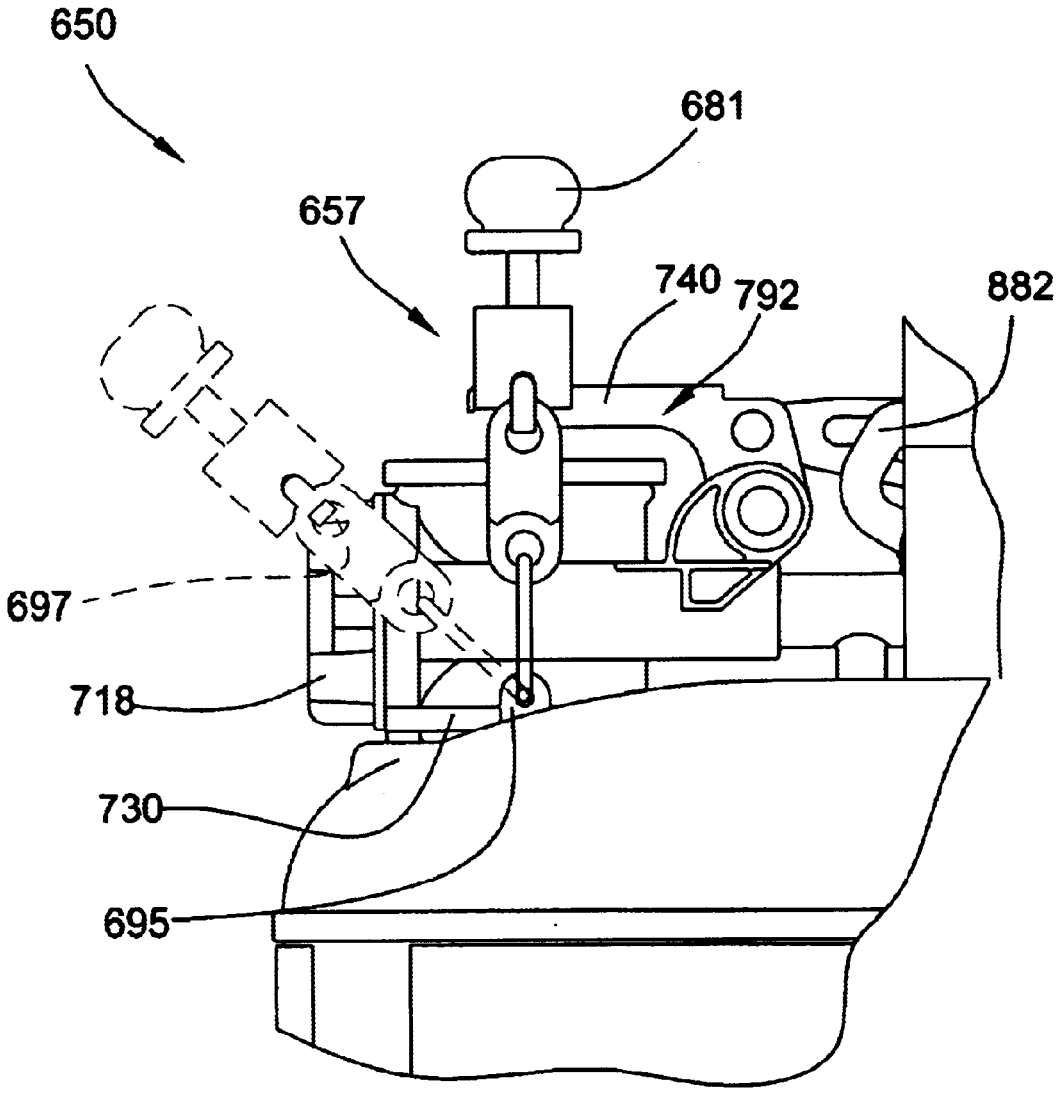
FIG. 33 is a fragmentary, side elevational view of the safety can of FIG. 30.

Referring to FIGS. 30 and 33, the clamp assembly 657 can be fixed in position with the thumbscrew 681 secured against the tip of the post extending from the fill cover 740 to prevent the trigger 882 from being able to move the fill cover assembly 792 to the open position, for facilitating safe transportation of the safety can 650, for example. The trigger 882 can be operated to place the valve mechanism 654 in a pour position with the clamp assembly 657 mounted to the fill cover assembly 792.

When not in use, the clamp assembly 657 can be rotated about the ears 695 of the mounting plate 730 to thereby reduce the risk of loss or damage to the clamp assembly 657 and to facilitate its use. The clamp assembly 657 can be rotated to a stored position, as shown in hidden lines in FIG. 33, wherein the thumbscrew 681 is set such that it is retained in a dimple 697 of the seat 718. The trigger 882 can be operated in the normal fashion to move the valve cover assembly 792 to an open position.

The safety can 650 is similar in other respects to the safety can shown in FIG. 1.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A safety can for storing liquid comprising:

a receptacle; and a valve mechanism, the valve mechanism mounted to the receptacle, the valve mechanism including:

a body having a fill spout and a pour spout, the spouts in communication with the receptacle, a fill cover movably mounted to the body to selectively move between a closed position wherein the fill spout is closed and an open position wherein the fill spout is open for filling the receptacle, a pour valve movably mounted to the body to selectively move between a closed position wherein the pour spout is closed and an open position wherein the pour spout is open for pouring from the receptacle, and a trigger movably mounted to the body, the trigger including a trigger portion, a connecting link, and a connecting rod, the trigger portion movably mounted to the body, the connecting link movably mounted to the fill cover, the connecting link including a trigger channel having a protrusion, the connecting rod extending through the trigger portion and the trigger channel to movably mount the trigger portion to the connecting link, the connecting link having a normal position wherein the connecting rod is disengaged from the protrusion, the trigger operable to move the fill cover to the open position by moving the connecting link away from the receptacle to engage the connecting rod with the protrusion and by moving the trigger portion in a first direction, the trigger operable to move the pour valve to the open position by moving the trigger portion in a second direction, the first direction being opposite to the second direction.

2. The safety can according to claim 1 wherein the receptacle includes a base, a side wall portion, and a dome, the dome and the side wall portion joined by a first seam, the side wall portion and the base joined by a second seam.

3. The safety can according to claim 1 wherein the receptacle includes a flanged portion, the body includes a mounting plate, the mounting plate being secured to the receptacle by the flanged portion.

4. The safety can according to claim 3 wherein the body includes a body portion and an O-ring, the body portion having a boss with an opening, the mounting plate having an opening that is aligned with the opening of the body portion, the boss of the body portion extending into the opening of the mounting plate, the O-ring disposed around the boss of the body portion to provide a seal between the body portion and the receptacle.

5. The safety can according to claim 1 wherein the body includes a main passage communicating with the receptacle, the fill spout, and the pour spout.

6. The safety can according to claim 5 wherein the body includes a flame arrestor disposed in the main passage.

7. The safety can according to claim 1 wherein the body includes a vent passage having a vent opening communicating with the receptacle and another opening communicating with the outside of the valve mechanism.

8. The safety can according to claim 7 wherein the pour valve is configured to open the vent passage when the pour valve is in the open position and to close the vent passage when the pour valve is in the closed position.

9. The safety can according to claim 7 wherein the body includes a vent flame arrestor disposed in the vent passage.

10. The safety can according to claim 1 wherein the body includes a plurality of stiffening ribs.

11. The safety can according to claim 1 wherein the body includes a body portion comprising die cast zinc.

12. The safety can according to claim 1 wherein the valve mechanism further includes a handle mounted to the body.

13. The safety can according to claim 1 wherein the fill cover includes a spring to bias the fill cover to the closed position.

14. The safety can according to claim 1 wherein the pour valve includes a seat mounted to the body such that it is aligned with the pour spout and a pivotally movable gasket, the gasket sealingly engaged with the seat to close the pour spout when the pour valve is in the closed position and the gasket detached from the seat to open the pour spout when the pour valve is in the open position.

15. The safety can according to claim 1 wherein the pour valve includes a spring to bias the pour valve to the closed position.

16. The safety can according to claim 1 wherein the body includes a pour valve passage for receiving the pour valve.

17. The safety can according to claim 16 wherein the body includes a vent passage having a vent opening communicating with the receptacle, the pour valve passage opening to the outside of the valve mechanism, the vent passage communicating with the pour valve passage, the pour valve disposed in the pour valve passage, the pour valve operable to close the valve passage when the pour valve is in the closed position and to open the valve passage when the pour valve is in the open position.

18. The safety can according to claim 17 wherein the pour valve includes a slide shaft disposed in the valve passage and first and second O-rings disposed on the slide shaft, the O-rings in sealing engagement with the valve passage and disposed on either side of the vent passage when the pour valve is in the closed passage to close the vent passage, a portion of the slide shaft which contains at least one of the O-rings disposed outside of the body when the pour valve is in the open position to open the vent passage.

19. The safety can according to claim 1 wherein the trigger includes a spring to bias the trigger portion to a normal position wherein both the fill spout and the pour spout are closed.

20. The safety can according to claim 1 wherein the trigger channel of the connecting link has a safety portion, the safety portion configured to allow the trigger portion to move in the first direction with the connecting rod disposed in the safety portion without moving the fill cover to the open position.

21. The safety can according to claim 1 wherein the trigger portion has a pour valve end that is configured to engage a portion of the pour valve to move the pour valve between the open position and the closed position upon respective movement of the trigger between the second direction and the first direction.

22. The safety can according to claim 21 wherein the pour valve has a longitudinal axis, and the pour valve end of the trigger portion acts upon the portion of the pour valve along a line of action that is substantially parallel to the longitudinal axis of the pour valve.

23. The safety can according to claim 1 wherein the trigger portion is pivotally mounted to the body about a trigger axis, the trigger portion includes a connecting portion through which the connecting rod extends, the trigger axis disposed between the connecting portion and the pour valve end.

24. The safety can according to claim 1 further comprising:

a hose attachment mounted to the body of the valve mechanism, the hose attachment communicating with the pour spout.

25. The safety can according to claim 1 further comprising:

a cage mounted to the receptacle, the cage surrounding the valve mechanism.

26. The safety can according to claim 1 further comprising:

a clamp assembly pivotally mounted to the valve mechanism, the clamp assembly operable to clamp the fill cover in the closed position such that moving the trigger in the first direction does not open the fill cover.

27. The safety can according to claim 26 wherein the clamp assembly includes a thumbscrew, the thumbscrew operable to retentively engage the fill cover when the clamp assembly is in a first position, the thumbscrew operable to retentively engage the body when the clamp is assembly is in a second position, the fill cover moveable between the open and closed positions when the clamp assembly is in the second position.

28. The safety can according to claim 26 wherein the clamp assembly includes a fusible link.

29. A safety can for storing liquid comprising: a receptacle and a valve mechanism mounted thereto, the valve mechanism including a fill spout selectively sealable by a fill cover, a separate pour spout selectively sealable by a pour valve, a trigger assembly for convenient multi-functional operation of the safety can whereby the trigger can be positioned to allow the can to be filled through the fill spout, to pour from the can from the pour spout, and to place the container in a normal position wherein both the fill spout and the pour spout are closed, the trigger assembly including a trigger, a connecting link, and a connecting rod to movably mount the trigger to the connecting link, the trigger assembly operable to open the fill cover upon engaging the connecting rod and the connecting link and moving the trigger toward the receptacle, the trigger operable to open the pour valve by moving the trigger away from the receptacle.

30. The safety can according to claim 29 wherein the trigger assembly can be moved to a safety position in the event that the trigger is moved toward the receptacle without first moving the connecting link away from the receptacle.

31. The safety can according to claim 29 further comprising: an integral automatic venting system to facilitate pouring liquid from the can, the venting system defining a vent path when the pour valve is opened, and the venting system closing the vent path when the pour valve is in a closed position.

32. A valve mechanism for a safety container for storing flammable liquid, the valve mechanism selectively operable to allow for the filling of the safety container with a liquid and to allow for the pouring of the liquid from the safety container, the valve mechanism comprising:

a body having a fill spout and a pour spout, the spouts in communication with the receptacle, a fill cover movably mounted to the body to selectively move between a closed position wherein the fill spout is closed and an open position wherein the fill spout is open for filling the receptacle, a pour valve movably mounted to the body to selectively move between a closed position wherein the pour spout is closed and an open position wherein the pour spout is open for pouring from the receptacle, and a trigger movably mounted to the body, the trigger including a trigger portion, a connecting link, and a connecting rod, the connecting link including a trigger channel having a protrusion, the connecting rod extending through the trigger portion and the trigger channel to movably mount the trigger portion to the connecting link, the connecting link movably mounted to the fill cover, the trigger portion movably mounted to the body, the trigger operable to move the fill cover to the open position by moving the connecting link away from the receptacle to engage the connecting rod and the protrusion and by moving the trigger portion in a first direction, the trigger operable to move the pour valve to the open position by moving the trigger portion in a second direction, the first direction being opposite to the second direction.

* * * * *